US005586428A

United States Patent [19]

Asai et al.

[11] Patent Number: 5,586,428

[45] Date of Patent: Dec. 24, 1996

[54] ROVING BOBBIN CHANGING METHOD AND APPARATUS FOR SPINNING MACHINE

[75] Inventors: Isao Asai; Toshinori Hasegawa, both of Kariya, Japan

[73] Assignee: Kabushiki Kaisha Toyoda Jidoshokki Seisakusho, Kariya, Japan

[21] Appl. No.: 277,899

[22] Filed: Jul. 20, 1994

[30] Foreign Application Priority Data

Jul. 26, 1993 [JP] Japan ..... 5-184152

[51] Int. Cl.[6] ..... D01H 9/00; D01H 9/10

[52] U.S. Cl. ..... 57/269; 57/261; 57/270; 57/278; 57/281

[58] Field of Search ..... 57/269, 267, 273, 57/278, 281, 90, 261, 268, 270

[56] References Cited

U.S. PATENT DOCUMENTS

| | | | |
|---|---|---|---|
| 4,799,353 | 1/1989 | Kawasaki et al. | 57/261 |
| 4,845,935 | 7/1989 | Mack | 57/261 |
| 4,899,531 | 2/1990 | Mack | 57/281 |
| 5,272,865 | 12/1993 | Sasaki et al. | 57/281 |
| 5,280,699 | 1/1994 | Igel et al. | 57/281 |

FOREIGN PATENT DOCUMENTS

| | | | |
|---|---|---|---|
| 3537727 | 5/1986 | Germany . | |
| 3734264 | 4/1989 | Germany . | |
| 3911764 | 10/1990 | Germany . | |
| 61-119728 | 6/1986 | Japan . | |
| 62-57957 | 3/1987 | Japan . | |
| 63-57478 | 3/1988 | Japan . | |
| 1052828 | 2/1989 | Japan | 57/281 |
| 2-127368 | 5/1990 | Japan . | |
| 4-352831 | 12/1992 | Japan | 57/261 |
| 5-44125 | 2/1993 | Japan . | |
| 5-132826 | 5/1993 | Japan . | |
| 5-195346 | 8/1993 | Japan | 57/281 |

*Primary Examiner*—William Stryjewski

*Attorney, Agent, or Firm*—Brooks Haidt Haffner & Delahunty

[57] ABSTRACT

Provided for a spinning machine, a roving bobbin changing apparatus which includes a roving end finding/pick-up section equipped with a roving end finding/pick-up mechanism at a leading side as viewed in a direction in which the roving bobbin changing apparatus is moved for roving bobbin exchange, and a roving tying/bobbin exchange section equipped with a roving bobbin exchanging means at a trailing side. The roving tying device is so disposed as to be movable between the roving end finding/pick-up section and the roving tying/bobbin exchange section. The roving tying device can be moved by a belt to a new roving grasping position in the roving end finding/pick-up section and a roving tying position corresponding to that of a full roving bobbin transfer means in the roving tying/bobbin exchange section. Operations for finding and picking up roving ends from a pair of full roving bobbins disposed on an auxiliary rail and operations for tying the rovings and transferring the full roving bobbins after the roving tying to bobbin hangers of a creel of a spinning machine are carried out in parallel.

11 Claims, 31 Drawing Sheets

ROVING BOBBIN CHANGING METHOD AND APPARATUS FOR SPINNING MACHINE

BACKGROUND OF THE INVENTION

1. Field of the Invention

The present invention relates to a roving bobbin changing method and apparatus for a spinning machine in which the roving bobbins changing operation is carried out by a roving bobbin changing apparatus which is adapted to move along a longitudinal axis of the spinning machine from one end of the machine frame toward the other end thereof.

2. Description of the Related Art

In the spinning machine typified by a ring spinning machine among others, rovings are drawn out from roving bobbins suspended on a creel of the spinning machine to be delivered to a draft part disposed below the creel. When the roving bobbins become empty or approach the empty state as the roving delivering to the draft part progresses, there arises a need for exchanging the empty or nearly empty roving bobbins (hereinafter referred to as the roving-depleted bobbins) with new or full roving bobbins. In that case, ends of the rovings drawn out from the full roving bobbins have to be connected or tied to the rovings being delivered from the roving-depleted bobbins or alternatively the rovings of the full roving bobbins must be inserted into the draft part.

In an effort to reduce the manpower involved in the spinning process, there has already been proposed a roving bobbin changing method (or sliver changing method) according to which the roving tying operation and the roving bobbin changing operation are carried out sequentially and progressively from one end of the machine frame of the spinning machine toward the other end thereof. By way of example, according to a roving bobbin changing method disclosed in Japanese Unexamined Patent Application Publication No. 57478/1988 (JP-A-63-57478), a roving bobbin changing apparatus performs an operation for finding and picking up roving ends from full roving bobbins (stocked full roving bobbins) and an operation for tying or connecting the roving ends as picked up to the rovings being delivered for spinning at the same positions. Thereafter the roving bobbin changing apparatus is moved to another position or work station where a next roving tying operation is to be carried out. Through the first mentioned operation, the roving-depleted bobbins are transferred to bobbin hangers suspended on the auxiliary rail, while the full roving bobbins are suspended on the bobbin hangers mounted on the creel of the spinning machine (this operation will be referred to as the roving bobbin exchanging operation) after the roving tying operation. In the meanwhile, the roving end finding/pick-up operation and the roving tying operation are carried out for the full roving bobbins.

According to the scheme disclosed in Japanese Unexamined Patent Application Publication No. 127368/1990 (JP-A-H2-127368), a work section for the roving bobbin changing operation is divided into three subsections, i.e., a roving end finding/pick-up section, a roving tying section, and a roving bobbin exchanging section. These three sections are sequentially disposed in tandem in the direction in which the roving bobbin changing apparatus is moved for performing the roving bobbin exchanging operation, and the operations in the individual work sections are carried out substantially concurrently with one another. More specifically, in the roving end finding/pick-up section, the roving ends are found and picked up from at least two full roving bobbins suspended on an auxiliary rail, while in the roving tying section the roving ends of the full roving bobbins as found and picked up are tied to the rovings being delivered from a pair of roving-depleted bobbins disposed in sequence. In the roving bobbin exchanging section, the pair of roving-depleted bobbins are transferred to the auxiliary rail after the roving tying operation, while the full roving bobbins which are now delivering the rovings are transferred to bobbin hangers mounted on the lower surface of the creel.

In recent years, there has arisen a prominent trend for increasing the operational speed of the spinning machine with a view to enhancing productivity. In accompaniment with the high-speed spinning, the diameter of the yarn-wound spool (or cop, to say in other way) has been reduced by controlling ballooning during the spinning operation in order to ensure a high quality of yarn. Under these circumstances, the cop change cycle becomes remarkably shortened. On the other hand, in view of the demand for manufacturing yarn at low costs, the spinning machine of low power consumption type which is equipped with a large number of spindles (on the order of 1,000 spindles) is increasingly used. This type spinning machine has a machine frame which is at least twice as long as that of the conventional spinning machine. Besides, there exists a necessity for carrying out the exchange of roving bobbins during operation of the spinning machine in order to prevent the manufacturing efficiency of the spinning machine from being reduced.

In this connection, the roving tying operation is realized by placing end portions of rovings picked up from full roving bobbins on rovings being delivered from roving-depleted bobbins over only a short length, and bonding together both rovings at a location immediately before the back rollers. Consequently, the bonded or tied portions of the rovings have an increased diameter, which often results in an undesirable situation in that the balloon is enlarged upon reception of the bonded or tied roving portions fed through front rollers, involving a high possibility of yarn breakage. Of course, when the cop has grown to a diameter in the range of from fifty to seventy percent of a full cop, yarn breakage becomes difficult to take place because the ballooning is then less significant as the distance between the snail wire, anti-node ring and the traveller is decreased. For this reason, in order to prevent the manufacturing efficiency from lowering by preventing the yarn breakage after the roving tying, it is necessary to start the roving bobbin changing operation when the cop diameter has increased up to a range of from fifty to seventy percent of the finished diameter. However, starting of the roving bobbin changing operation with the aid of a roving bobbin changing apparatus at a time when the cop has reached the diameter mentioned above is accompanied by the problem that the cop may become full before the roving bobbin changing operation has been completed for all the roving bobbins in a spinning machine if a lot of time is taken for the roving bobbin exchanging process. This may result in stoppage of the spinning machine and interference between the roving bobbin changing apparatus and the cop changer. Thus, there exists a need for a high speed roving bobbin exchanging facility in order to meet a demand for preventing the above-mentioned interference and increasing the number of spinning machines to be serviced by a single roving bobbin changing apparatus.

According to the roving bobbin changing method described in Japanese Unexamined Patent Application Publication No. 57478/1988 (JP-A-63-57478), the roving end finding/pick-up operation and the roving tying operation are effected at one and the same location and, after completion of the roving tying operation, the roving bobbin changing apparatus is moved to a succeeding roving tying position to thereby carry out the roving tying operation with the roving bobbin changing operation being carried out concurrently at the same position. However, the roving end finding/pick-up operation and the roving tying operation require a longer time when compared with the time taken by the roving bobbin-changing operation. Consequently, even when one cycle of the roving bobbin changing process is performed almost concurrently, the relatively long time required for completing the roving end finding/pick-up operation and the roving tying operation in one cycle provides an obstacle in realizing a reduction in the time for the roving bobbin changing apparatus to stay at one and the same place. As a result, the time required for completing the roving bobbin changing process for the whole spinning machine is unavoidably increased, giving rise to a problem.

On the other hand, in the case of the roving bobbin changing scheme taught in Japanese Unexamined Patent Application Publication No. 127368/1990 (JP-A-H2-127368) mentioned previously, the work section for a roving bobbin changer is divided into three subsections, i.e. a roving end finding/pick-up section, a roving tying section, and a roving bobbin exchanging section, and the relevant operations are performed concurrently. As a consequence, the time for the roving bobbin changing apparatus to stay at one place can be reduced, whereby the time required for completing the roving bobbin changing operation for a whole spinning machine can significantly be shortened. However, this prior art roving bobbin changing scheme suffers from a problem that the control becomes much more complicated because of the large number of work sections to be monitored. Besides, upon occurrence of a trouble in a given one of the sections in the course of performing the allocated operation, the apparatus has to be restored to the original position, whereupon the roving bobbin changing process is started again, which thus incurs a problem that the burden imposed on the operator who is in charge of monitoring and controlling the roving bobbin changing process will intolerably be increased.

Such being the circumstances, there exists a great demand for a roving bobbin changing method and apparatus which allows the time taken for the roving bobbin changing operation for one spinning machine to be significantly shortened without involving complication in the control of the roving bobbin changing apparatus or increasing the burden imposed on the operator.

SUMMARY OF THE INVENTION

In the light of the state of the art described above, it is an object of the present invention to provide a roving bobbin changing method and an apparatus for carrying out the same which can satisfactorily meet the demand mentioned just above.

In view of the above and other objects which will become apparent as description proceeds, there is provided according to a first aspect of the invention a roving bobbin changing method for replacing roving-depleted bobbins, which are suspended on bobbin hangers of a creel of a spinning machine and which are delivering rovings to undergo spinning, with full roving bobbins which are suspended on an auxiliary rail disposed in front of the creel using a roving bobbin changing apparatus which is adapted to move in a direction longitudinal of the spinning machine from one end to the other end of the machine frame. The work section of the roving bobbin changing apparatus is divided into two subsections, i.e., a roving end finding/pick-up section in which a roving end finding/pick-up mechanism operates for finding roving ends from at least two full roving bobbins disposed on the auxiliary rail, and a roving tying/bobbin exchange section in which a roving tying mechanism operates for tying roving ends found and picked up from the full roving bobbins to rovings being delivered from the roving-depleted bobbins. A roving bobbin exchange mechanism operates for transferring the roving-depleted bobbins to the auxiliary rail while transferring to the bobbin hangers of the creel the full roving bobbins which have roving ends tied and from which the rovings are currently being delivered. Both sections are disposed in tandem in the direction in which the roving bobbin changing apparatus is moved for the roving bobbin changing operation, and the operations in both sections are carried out substantially concurrently with one another.

Further, according to a second aspect of the invention, there is provided a roving bobbin changing apparatus which includes a roving end finding/pick-up mechanism for finding and picking up roving ends from at least two full roving bobbins disposed on an auxiliary rail extending in front of a creel of a spinning machine, a roving tying mechanism for tying the roving ends as found and picked up from the full roving bobbins to rovings delivered from roving-depleted bobbins, and a roving bobbin exchanging mechanism for transferring the roving-depleted bobbins to the auxiliary rail while transferring to bobbin hangers of the creel the full roving bobbins from which rovings are currently being delivered for spinning. A roving end finding/pick-up section in which the roving-end finding/pick-up mechanism is disposed at a leading end as viewed in the direction in which said roving bobbin changing apparatus is moved for performing the roving bobbin exchanging operation, and a roving tying/bobbin exchange section having the roving bobbin exchanging mechanism disposed therein are provided in tandem. The roving bobbin exchanging mechanism is disposed to be reciprocatively movable between the roving end finding/pick-up section and the roving tying/bobbin exchange section. A driving mechanism is included for moving the roving bobbin exchanging mechanism to a position for grasping new rovings in the roving end finding/pick-up section and to a roving tying position corresponding to that of the full roving bobbins transfer mechanism in the roving tying/bobbin exchange section.

In a preferred mode for carrying out the invention, the roving bobbin exchanging mechanism may be comprised of a full roving bobbin transfer mechanism and a roving-depleted bobbin transfer mechanism, wherein the full roving bobbin transfer mechanism and the roving-depleted bobbin transfer mechanism may be so arranged as to be driven or operated independently of each other.

According to the teachings of the present invention incarnated in the structures mentioned above, the roving bobbin changing apparatus is moved from one end of the frame of the spinning machine when roving bobbins delivering rovings for spinning become depleted of the rovings and is stopped at a first work position corresponding to the full roving bobbins suspended from the auxiliary rail in the roving end finding/pick-up section. At this position, the roving ends are picked up from the full roving bobbins suspended on the auxiliary rail by the roving end finding/pick-up mechanism. Thereafter, the roving bobbin changing apparatus is moved to a succeeding work position at which the roving ends picked up at the preceding work position are tied to rovings being derived from the roving-depleted bobbins by operating the roving tying mechanism in the roving tying/bobbin exchange section. Further, by actuating the roving bobbin exchanging mechanism, the roving-depleted bobbins are suspended on the auxiliary rail while the full roving bobbins now delivering rovings for the spinning are suspended on the bobbin hangers of the creel after the roving tying operation. On the other hand, in the roving end finding/pick-up section, the roving end pick-up operation is performed for succeeding full roving bobbins. Subsequently, the roving bobbin changing apparatus is moved progressively and sequentially in the longitudinal direction of the spinning machine frame to carry out the roving end finding/pick-up operation and the roving tying/bobbin exchange operation substantially concurrently. Because the time taken for the roving end finding/pick-up operation is substantially equal to the time required for the roving tying/bobbin exchange operation, the period during which the roving bobbin changing apparatus is forced to stay at one work position is substantially equal to the time taken for a single roving end pick-up operation or the time taken for the roving tying/bobbin exchange operation, whereby the time required for completing the roving change operation for a whole spinning frame can be remarkably reduced.

Thus, according to the invention, the time taken for the roving tying operation and the roving bobbin exchanging operation performed by the roving bobbin changing apparatus for one spinning machine can be significantly shortened without involving complication in the control of the roving bobbin changing apparatus or increasing the burden imposed on the operator for coping with possible trouble.

Further, when the full roving bobbin transfer mechanism and the depleted-roving bobbin transfer mechanism of the roving bobbin changing apparatus are arranged so as to be driven independently of each other, a part of the roving bobbin exchanging operation can be carried out concurrently during the roving tying operation, whereby the time taken for the roving tying/bobbin exchange operation can be further reduced.

The above and other objects, features and attendant advantages of the present invention will be more clearly understood by reading the following description of the preferred embodiments thereof taken, only by way of example, in conjunction with the drawings.

BRIEF DESCRIPTION OF THE DRAWINGS

FIG. 11(*b*) is a view similar to FIG. 11(*a*) and shows the roving drawing member located at an operating position;

DESCRIPTION OF THE PREFERRED EMBODIMENTS

Now, the present invention will be described in detail in connection with the preferred or exemplary embodiments thereof by reference to the drawings. Parenthetically, it should be understood that the terms "front", "frontwardly", "rear", "rearwardly", "left", "right", "forward", "reverse", "leading", "trailing" and the like used herein are only for convenience of description and should not be interpreted in a limiting sense.

Figure 3:
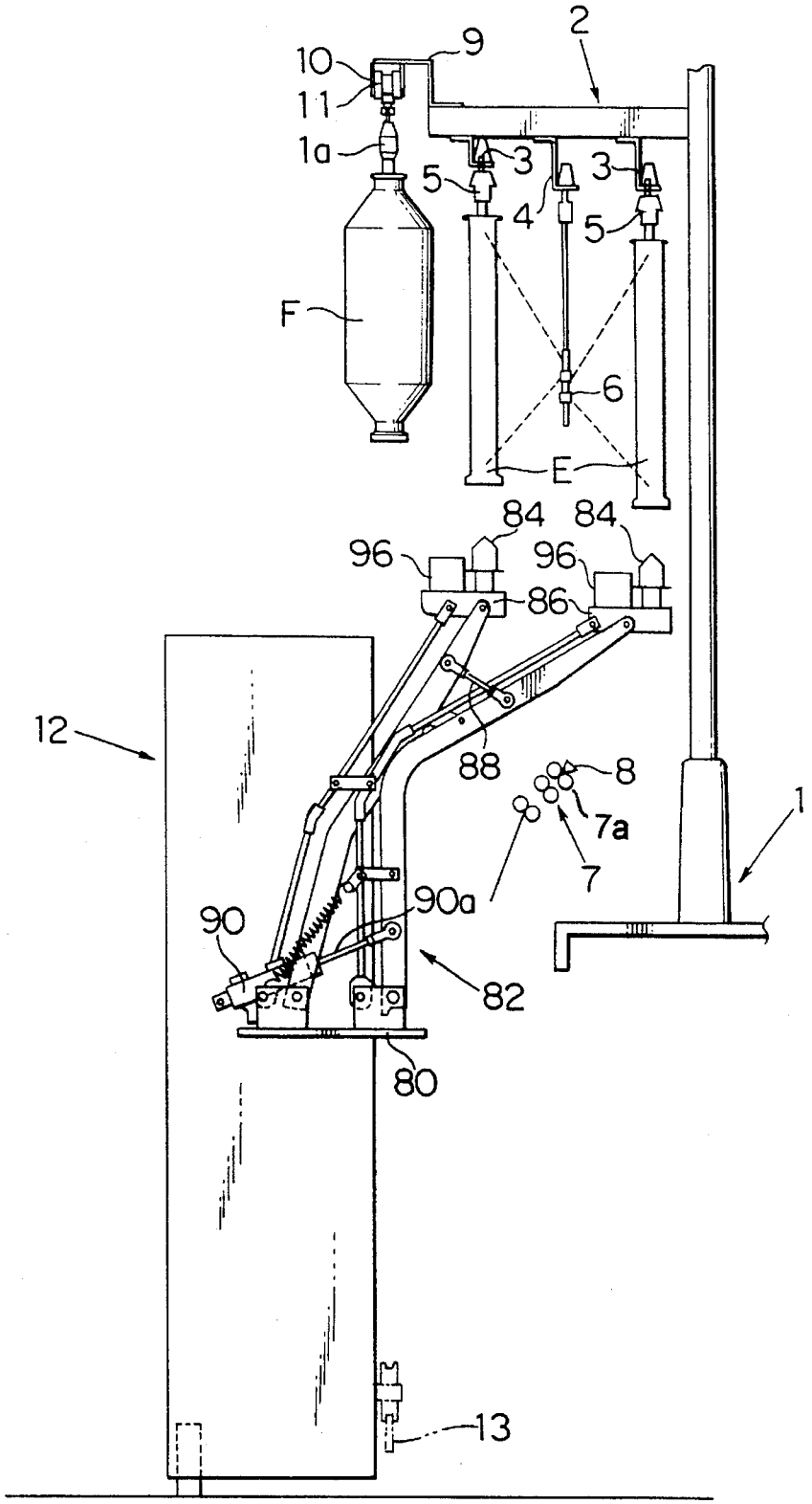
FIG. 3 is a side elevational view showing a roving-depleted bobbin transfer mechanism of the apparatus in a state in which bobbin exchange arm assemblies are inclined frontwards.
Figure 15:
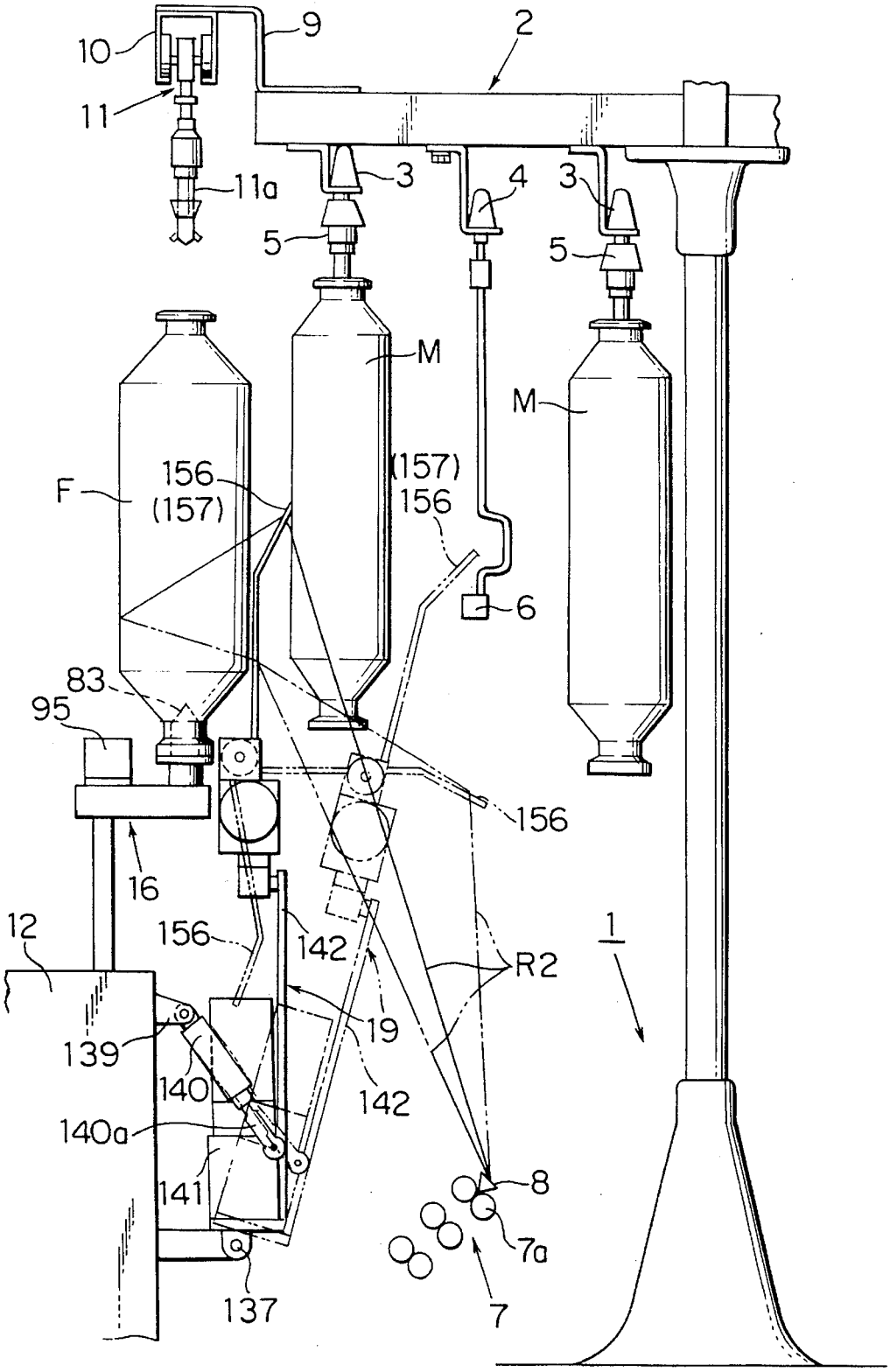
FIG. 15 is a side elevational view showing schematically the roving introducing and attaching mechanism.

Referring to FIGS. 3 and 15, creels 2 (only one of which is shown) are disposed at both sides (only one side is shown) of a spinning machine 1. A pair of inner and outer roving bobbin rails 3 are fixedly mounted on each of the creels 2 and extend in parallel with each other in the longitudinal direction of the spinning machine 1 (i.e., in the direction perpendicular to the plane of the drawing). Further, a supporting rail 4 is additionally mounted fixedly on the creel 2 and extends in parallel with the roving bobbin rails 3 in the longitudinal direction of the machine frame. Each of the roving bobbin rails 3 is equipped with bobbin hangers 5 at a predetermined distance therebetween which is twice as large as a spindle pitch. Each of the rovings drawn out from the roving bobbins suspended by the bobbin hangers 5 is introduced or led into a trumpet 8 of a draft part 7 by way of a roving guide 6. To this end, the roving guide 6 is provided with a pair of guide recesses. Further, a supporting bracket 9 is mounted on the creel 2 and extends laterally outwardly. At a free end portion of the supporting bracket 9, a transportation rail 10 is mounted as an auxiliary rail and extends in parallel with the roving bobbin rail 3. Suspended by the transportation rail 10 are bobbin carriages 11 each equipped with a bobbin hanger 11*a*.

Figure 1:
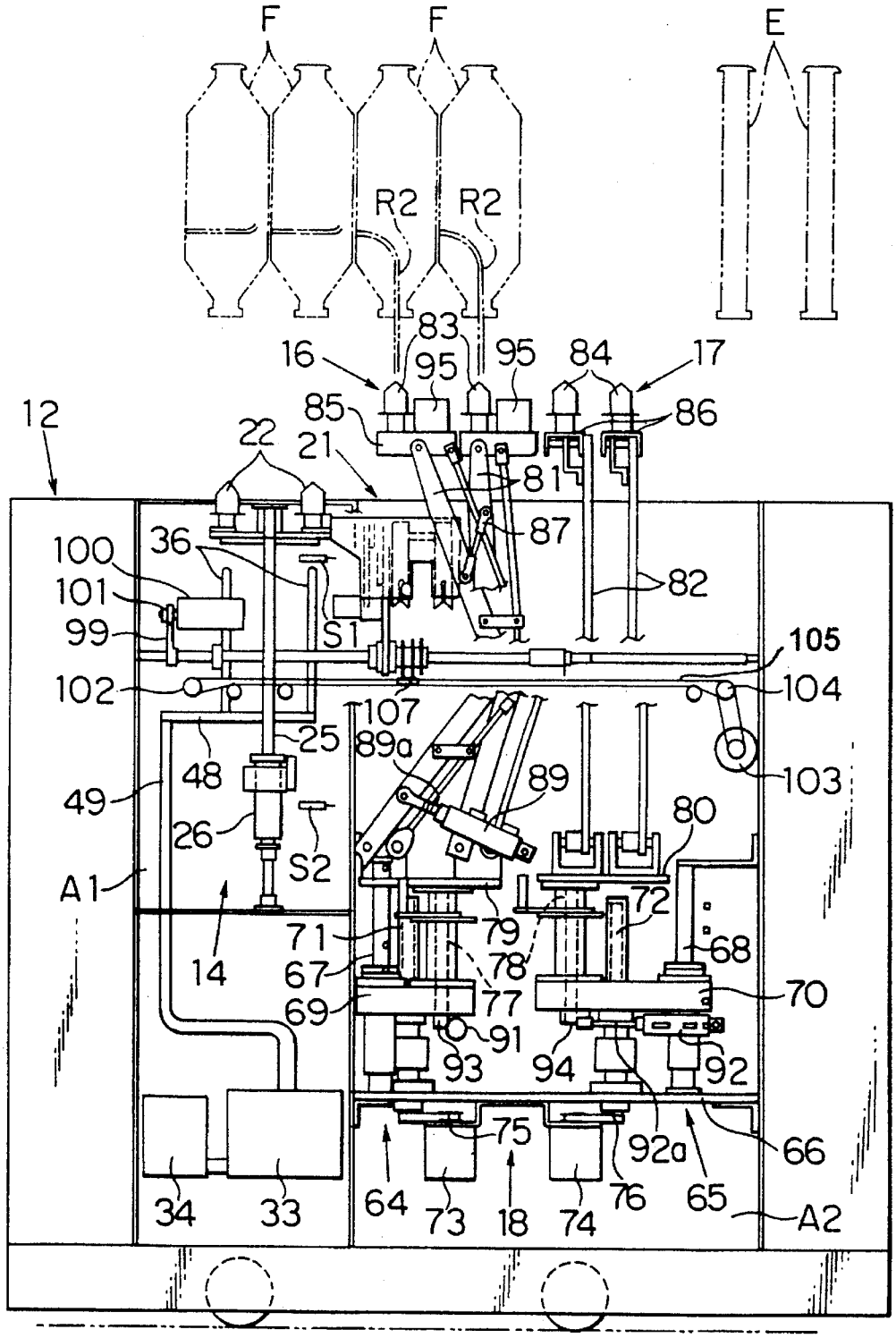
FIG. 1 is a rear side elevational view showing schematically a structure of a roving bobbin changing apparatus according to an embodiment of the present invention.
Figure 2:
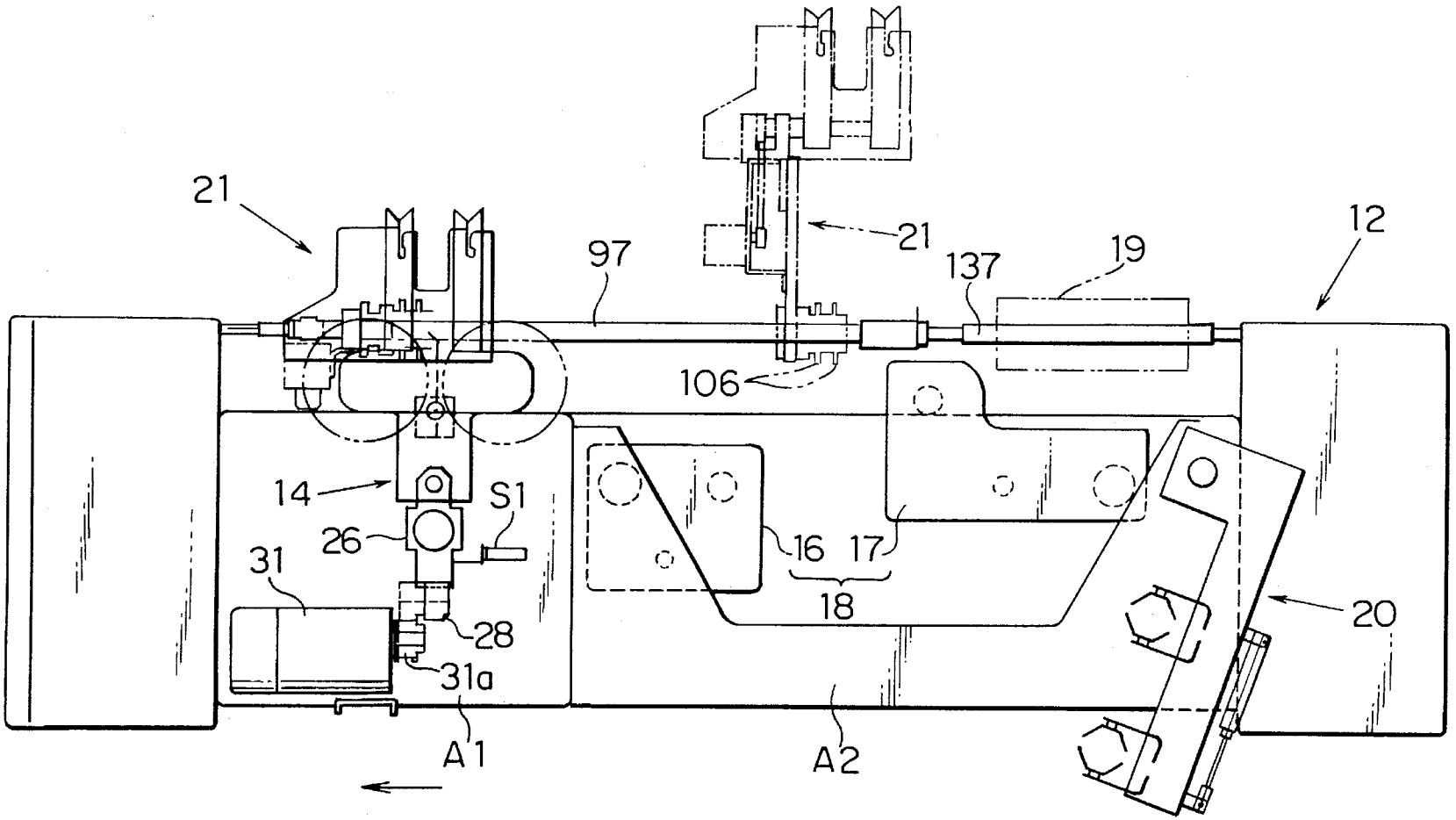
FIG. 2 is a top plan view showing schematically the roving bobbin changing apparatus.

A roving bobbin changing apparatus 12 is installed so as to be movable along a guide rail 13 extending in the longitudinal direction of the frame of the spinning machine. The roving bobbin changing apparatus 12 is so controlled as to stop at predetermined positions for exchanging a full roving bobbin with a roving-depleted bobbin. Referring to FIGS. 1 and 2, the roving bobbin changing apparatus 12 is provided with a roving end finding/pick-up section A1 at a leading side as viewed in the direction in which the roving bobbin changing apparatus 12 is moved for exchanging the bobbin (i.e., left side as viewed in FIG. 1) as well as a roving tying/bobbin exchange section A2 provided at a trailing side (right-hand side as viewed in FIG. 1). There are disposed in the roving end finding/pick-up section A1 a full roving bobbin support/lift mechanism 14 for lowering full roving bobbins F suspended by the bobbin hangers 11*a* to a position where the roving end finding/pick-up operation can easily be performed, and a roving end finding/pick-up mechanism 15 for finding ends of rovings wound on the full roving bobbins (also referred to as the roving cop) F. In the roving end finding/pick-up section A1, the roving end finding/pick-up operation is performed for finding and picking up ends of the rovings wound on a pair of full roving bobbins.

In the roving tying/bobbin exchange section A2, there are provided a bobbin exchanging mechanism 18 which is comprised of a full roving bobbin transfer mechanism 16 and a roving-depleted bobbin transfer mechanism 17, a roving attaching mechanism 19 for introducing or leading new or succeeding rovings R2 extending from full roving bobbins F to the draft part 7 after completion of the roving tying operation and a roving depleted bobbin holding mechanism 20. Further, a roving tying mechanism 21 for tying or connecting the found roving ends of full roving bobbins F to the old or preceding rovings R1 delivered from the roving-depleted bobbins E is so disposed as to be movable reciprocatively between the roving end finding/pick-up section A1 and the roving tying/bobbin exchange section A2.

In the roving tying/bobbin exchange section A2, the operations mentioned below are primarily carried out. The first operation is to tie found ends of rovings from a pair of the full roving bobbins F to the preceding rovings R1 being delivered from a pair of inner and outer roving-depleted bobbins E. The second operation is to move or transfer the inner and outer roving-depleted bobbins E to the bobbin hangers 11*a* mounted on the bobbin carriages 11 after the roving tying operation, while transferring the full roving bobbins F from which rovings are now being delivered after the tying operation to a pair of inner and outer bobbin hangers 5 suspended from the creel 2. The third operation is to introduce into the roving guide 6 the succeeding or new rovings R2 delivered from the full roving bobbins F and extending to the draft part 7 after the roving tying operation.

Figure 4:
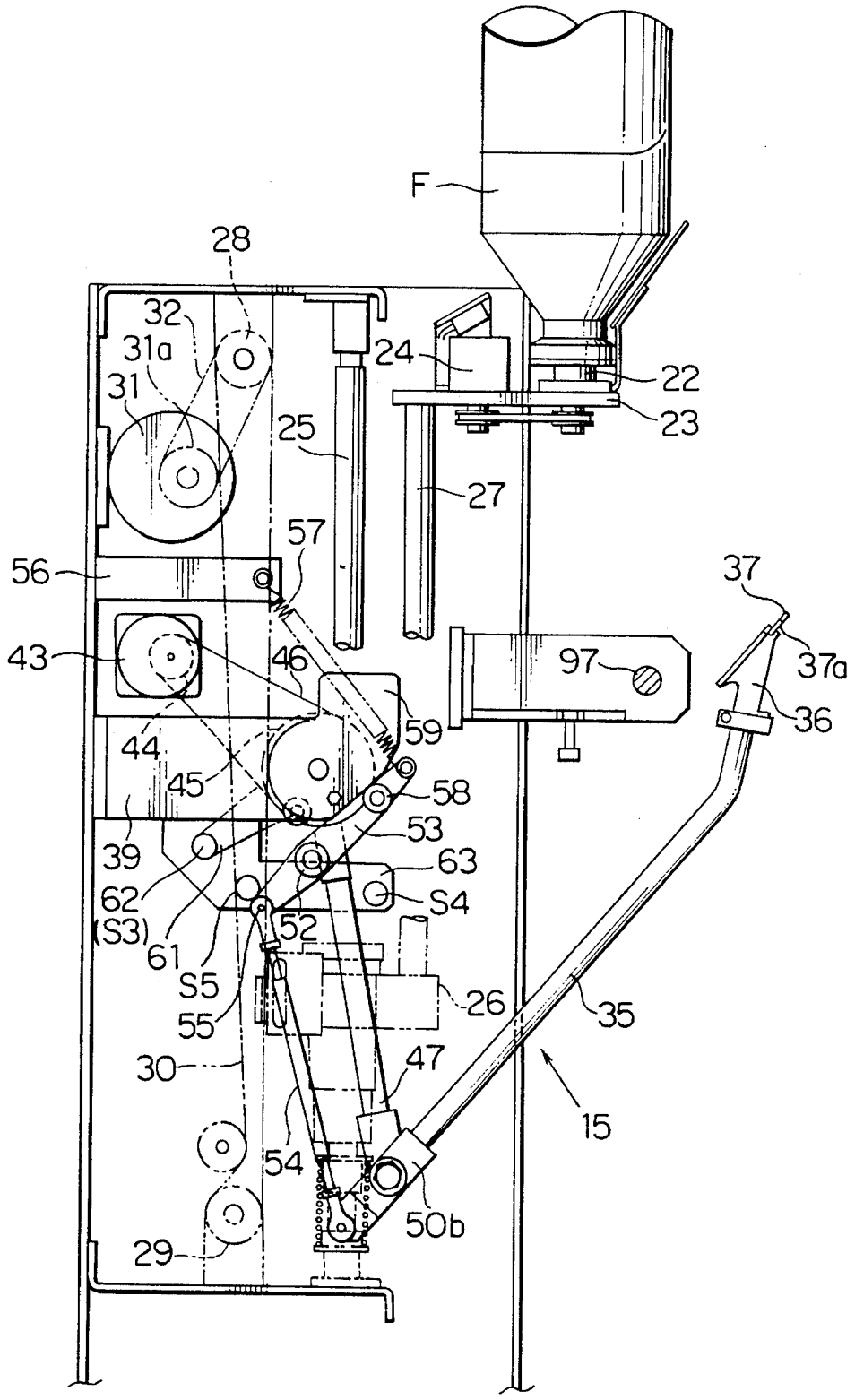
FIG. 4 is a fragmental side elevational view showing a roving end finding/pick-up mechanism and a full roving bobbin support/lift mechanism with some parts being omitted from illustration.

As shown in FIGS. 1 and 4, the full roving bobbin support/lift mechanism 14 includes a supporting platform 23 equipped with a pair of pegs 22 and a driving unit for lifting and lowering the supporting platform 23. Both of the pegs 22 are adapted to be rotated by an electric motor 24 via a belt transmission mechanism. A guide shaft 25 constituted by a spline shaft is fixedly mounted on a frame of the roving bobbin changing apparatus 12 in a vertically upstanding state, wherein a supporting bracket 26 is slidably supported on the guide shaft 25. A supporting column 27 is fixedly secured at a proximal end thereof to a front portion (right-hand portion as viewed in FIG. 4) of the supporting bracket 26. The supporting platform 23 is fixedly secured to the supporting column 27 at a top end thereof in a horizontal disposition. A pair of pulleys 28 and 29 are rotatably supported at the rear side of the guide shaft 25 at positions corresponding to the top and bottom ends of the guide shaft 25, wherein a toothed belt 30 is spanned between and around the pulleys 28 and 29. Driving torque generated by an electric motor 31 is transmitted to the pulley 28 by way of a pulley 31*a* snugly secured to the output shaft of the electric motor 31 and a belt 32. It should be noted that the supporting bracket 26 is so secured to the toothed belt 30 as to be movable in unison with the latter. More specifically, upon movement of the toothed belt 30 responsive to a forward or reverse rotation of the electric motor 31, the supporting platform 23 can be moved in a corresponding vertical direction in unison with the supporting bracket 26. When the supporting platform 23 has attained a predetermined position in the course of upward or downward movement, this is detected by a sensor S1 or S2. In response to the sensor output signal, the electric motor 31 is stopped.

Figure 5:
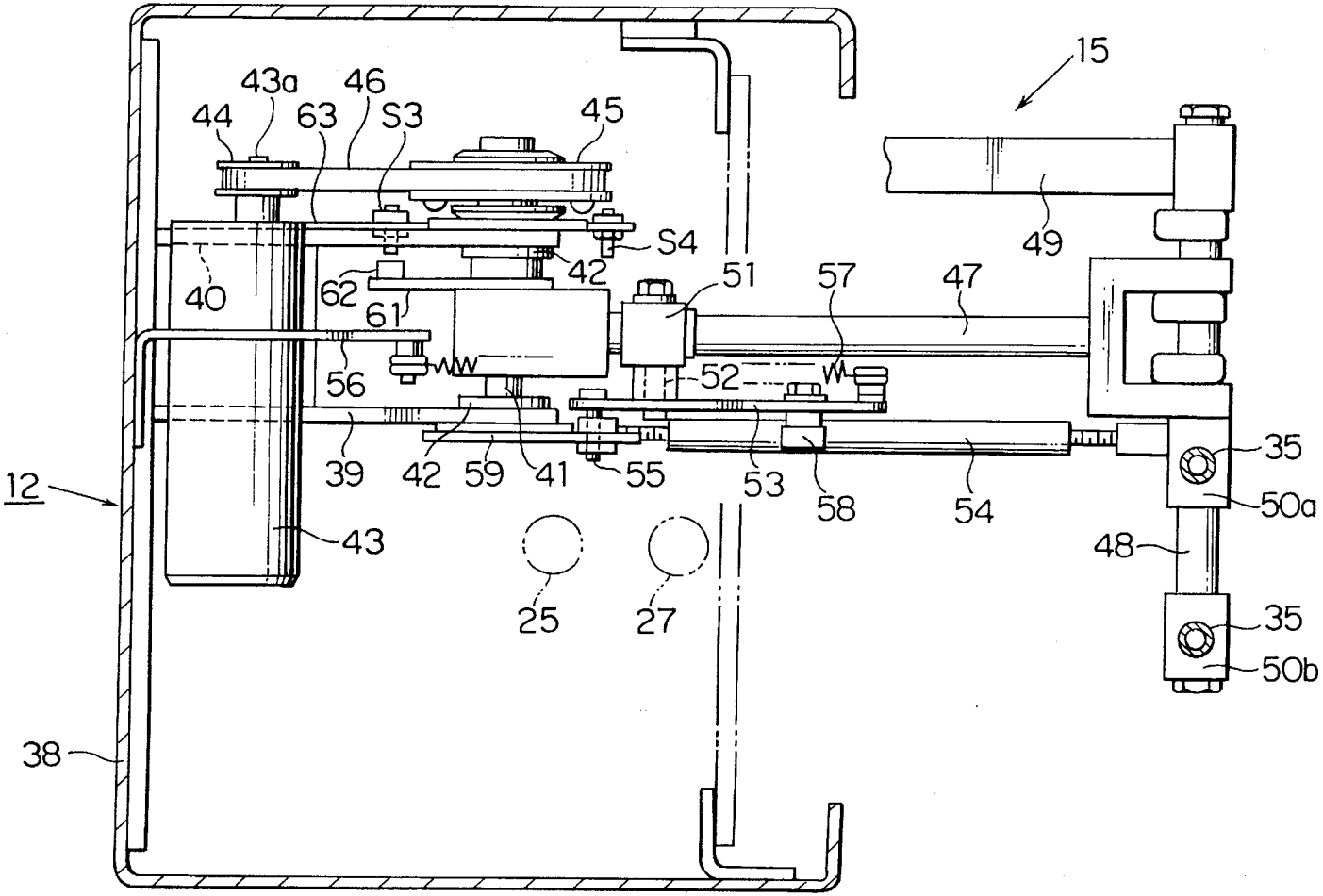
FIG. 5 is a top plan view showing a roving end finding/pick-up mechanism with some parts being omitted from illustration.

As can be seen in FIGS. 1, 4 and 5, the roving end finding/pick-up mechanism 15 is disposed in proximity to the full roving bobbin support/lift mechanism 14. The roving end finding/pick-up mechanism 15 is comprised of a roving chip collecting box 33 disposed below the roving bobbin changing apparatus 12, a blower 34 connected to the roving chip collecting box 33 through a hose (see FIG. 1), and a pair of suction nozzles 36 connected to the roving chip collecting box 33 through suction pipes 35 (only one is seen in FIG. 4). As is best shown in FIG. 4, a roving cutting member 37 is fixedly disposed at an inlet port of each of the suction nozzles 36. A roving cutting member 37 has one end portion formed in a comb-like shape and projecting into the suction nozzle 36 and the other end portion projecting outwardly from the associated suction nozzle 36 and provided with an engaging part 37*a* formed in a comb-like shape so as to be engageable with the rovings.

Referring to FIGS. 4 and 5, a frame 38 of the roving bobbin changing apparatus 12 is provided with a pair of projecting brackets 39 and 40, and a rotatable shaft 41 is supported rotatably between the brackets 39 and 40 by means of bearings 42 mounted on the brackets 39 and 40, respectively. An electric motor 43 is mounted above the brackets 39 and 40 and has an output shaft 43*a*. A toothed pulley 44 is mounted on the output shaft 43*a* so as to rotate in unison with the latter. The rotatable shaft 41 has a first end portion on which a toothed pulley 45 is mounted rotatably together with the rotatable shaft 41. A toothed belt 46 is spanned between and around the toothed pulleys 44 and 45 and extends therearound. In this manner, the rotatable shaft 41 can be driven by the toothed pulley 45 through the transmission mechanism including the toothed pulleys 44 and 45 and the toothed belt 46.

Fixedly mounted on the rotatable shaft 41 at an intermediate portion thereof is a supporting arm 47 at a base or proximal end thereof so as to be rotatable together with the shaft 41. Supported by the supporting arm 47 at a tip or distal end thereof is a supporting pipe 48 which extends in the direction in which the roving bobbin changing apparatus 12 is moved upon a roving bobbin exchanging operation. The supporting pipe 48 has one end portion to which a first end portion of a connecting pipe 49 made of a flexible tube is coupled. The connecting pipe 49 has a second end portion joined to the roving chip collecting box 33. In this connection, it is to be noted that supporting blocks 50*a* and 50*b* are fixedly secured to the supporting pipe 48 so as to be rotatable with the latter. Fixedly connected to the supporting blocks 50*a* and 50*b* are a pair of suction pipes 35 at proximal end portions thereof, respectively, each of the suction pipes 35 having a suction nozzle 36 secured at the distal end thereof. Each of the supporting blocks 50*a* and 50*b* has a passage (not shown) formed therethrough for communicating the supporting pipe 48 and the suction pipe 35 to each other. In this way, a negative pressure or vacuum within the roving chip collecting box 33 acts on the suction nozzles 36 by way of the connecting pipes 49, the supporting pipes 48, the supporting blocks 50*a* and 50*b* and the suction pipes 35.

Secured fixedly to the supporting arm 47 at a position near to the proximal end thereof is a block 51 to which a supporting shaft 52 is secured so as to extend in parallel with the supporting pipe 48. A rotatable lever 53 is rotatably supported on the supporting shaft 52. A first end portion of a connecting rod 54 is pivotally connected to a first end portion (bottom end portion as viewed in FIG. 4) of the rotatable lever 53 by means of a pin 55. The connecting rod 54 has a second end portion at which the connecting rod 54 is pivotally connected to an end portion of the block 50*a*. Disposed stationarily above the electric motor 43 is a supporting bracket 56 which has a distal end portion operatively coupled to the rotatable lever 53 at the second end portion thereof by means of a coil spring 57 interposed therebetween. The rotatable lever 53 is provided with a cam follower 58 mounted at a position closer to the second end portion of the rotatable lever 53. Parenthetically, it should be mentioned that in FIG. 5, the rotatable lever 53 is shown in a state reached after the rotatable lever 53 has been revolved about 30° in the clockwise direction from the state shown in FIG. 4.

On the other hand, secured to the bracket 39 is a cam 59 which has a cam surface onto which the cam follower 58 bears. The cam follower 58 and the cam 59 cooperate to change the angle formed between the block 50*a* and the supporting arm 47 via the rotatable lever 53 and the connecting rod 54. Further, secured to the rotatable shaft 41 so as to rotate therewith is a lever 61 having a distal end at which a mark projection 62 is formed. A supporting plate 63 is fixedly secured to the bracket 40. Three sensors S3, S4 and S5 are mounted fixedly to the bracket 40 for detecting the mark projection 62. More specifically, the sensor S3 is disposed at a position capable of detecting the mark projection 62 when the suction nozzles 36 assume the stand-by position, while the sensor S4 is disposed at a position capable of detecting the mark projection 62 when the suction nozzles 36 are indexed to the roving end finding/pick-up position. Further, the sensor S5 is disposed at a position for detecting the mark projection 62 when the suction nozzles 36 come to a roving pick-up position.

The roving bobbin exchanging mechanism 18 is so disposed that the full roving bobbin transfer mechanism 16 is located ahead of the roving bobbin exchanging mechanism 18 with the roving-depleted bobbin transfer mechanism 17 following the roving bobbin exchanging mechanism 18 as viewed in the direction in which the roving bobbin changing apparatus 12 is moved for the roving bobbin changing operation. Both of the full roving bobbin transfer mechanism 16 and the roving-depleted bobbin transfer mechanism 17 may basically be implemented in substantially the same structures as those disclosed in Japanese Unexamined Patent Application Publication No. 119728/1986 (JP-A-61-119728) except that lift mechanisms 64 and 65 are provided independently. As can be seen in FIG. 1, a supporting frame 66 is disposed horizontally at a position close to a bottom side of the roving tying/bobbin exchange section A2, and the full roving bobbin transfer mechanism 16 and the roving-depleted bobbin transfer mechanism 17 are disposed on the supporting frame 66.

More specifically, ball splines 67 and 68 constituting parts of the lift mechanisms 64 and 65, respectively, are mounted on the supporting frame 66 in the upstanding state, and supporting blocks 69 and 70 are supported on the ball splines 67 and 68, respectively, so as to be movable in the vertical direction. The supporting blocks 69 and 70 are equipped with respective ball nuts (not shown) which are adapted to engage screwwise with ball screws 71 and 72 installed in parallel with the ball splines 67 and 68, respectively, so that the ball nuts can be moved upwardly or downwardly depending on the forward or reverse rotation of the ball screws 71 and 72 which are adapted to be rotationally driven by electric motors 73 and 74 secured to the lower surface of the supporting frame 66 via belt transmissions 75 and 76, respectively.

Supported on the supporting blocks 69 and 70 are rotatable shafts 77 and 78 so as to extend in parallel with the ball splines 67 and 68 and to be movable in unison with the supporting blocks 69 and 70, respectively, and vertically movable base plates 79 and 80 are secured on the top ends of the rotatable shafts 77 and 78 respectively, so as to be rotatable together with the latter. As is shown in FIGS. 1 and 3, bobbin exchange arm assemblies 81 and 82 each constituted by a four-joint linkage are disposed on the upper sides of the vertically movable base plates 79 and 80, respectively, and supporting plates 85 and 86 having respective pegs 83 and 84 are supported at the top ends of the supporting plates 85 and 86, respectively. The bobbin exchange arm assemblies 81 and 82 are interconnected by connecting rods 87 and 88. Secured fixedly to the vertically movable base plates 79 and 80 are cylinders 89 and 90 of which piston rods 89*a* and 90*a* are coupled to the bobbin exchange arm assemblies 81 and 82, respectively.

Figure 6:
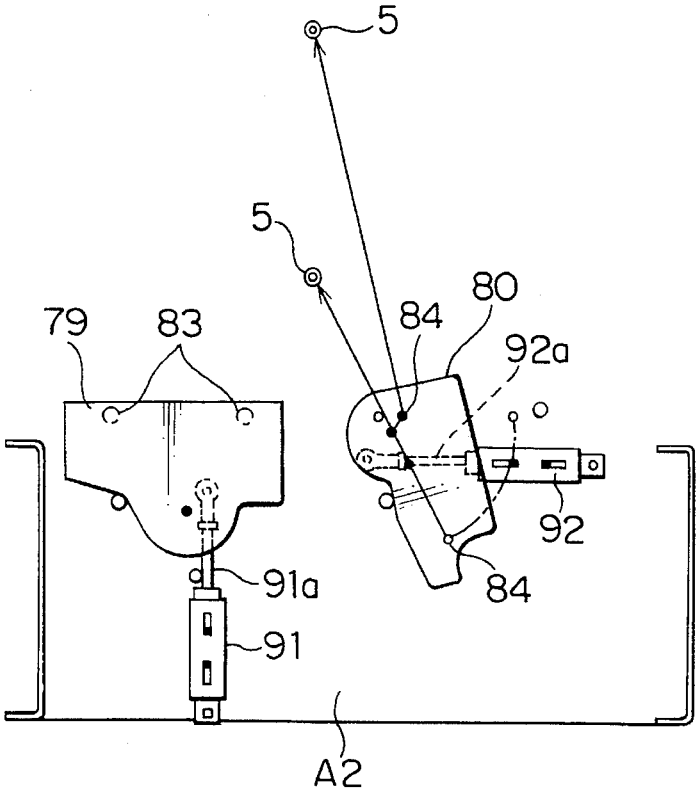
FIG. 6 is a schematic top plan view showing the positional relation of pegs in a bobbin exchanging mechanism.
Figure 7:
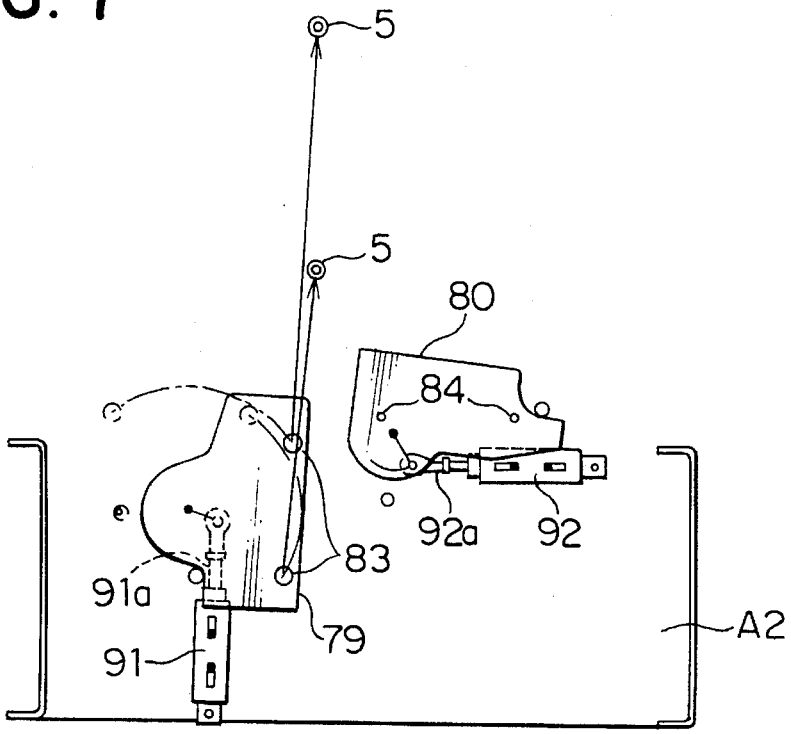
FIG. 7 is a schematic top plan view showing the positional relation of pegs in the bobbin exchanging mechanism in another stage of operation.

Supported horizontally on the lower sides of the supporting block 69 and 70 are cylinders 91 and 92 by means of brackets (not shown), respectively, wherein piston rods 91*a* and 92*a* of the cylinders 91 and 92 are connected to coupling members 93 and 94 secured to the rotatable shafts 77 and 78 at the bottom ends thereof, respectively. As shown in FIGS. 6 and 7, the cylinder 91 of the full roving bobbin transfer mechanism 16 is disposed in such orientation as to intersect orthogonally the longitudinal axis of the roving bobbin changing apparatus 2. In the state of the cylinder 91 where the piston rod 91*a* projects outwardly, the vertically movable base plate 79 is disposed at a position where correspondence is established between the pegs 83 and the bobbin hangers 11*a*. On the other hand, in the state where the piston rod 91*a* is retracted, the vertically movable base plate 79 is disposed at a position wherein the pegs 83 are opposite to the positions which bear correspondence to the two inner and outer bobbin hangers 5, respectively, when the bobbin exchange arm assembly 81 is inclined frontwards, as shown in FIG. 7.

The cylinder 92 of the roving-depleted bobbin transfer mechanism 17 is disposed so as to extend substantially in parallel with the longitudinal axis of the roving bobbin changing apparatus 12. In the state where the piston rod 92*a* is retracted, the vertically movable base plate 80 is disposed at a position where the pegs 84 bear a face-to-face relation to the bobbin hanger 11*a*, as shown in FIG. 7. On the other hand, in the state where the piston rod 92*a* projects outwardly, the vertically movable base plate 80 is disposed at a position wherein the pegs 84 are opposite to the positions corresponding to the two inner and outer bobbin hangers 5 when the bobbin exchange arm assembly 82 is inclined frontwards, as can be seen in FIG. 6.

When the cylinder rods 89*a* and 90*a* are extended in the state where the vertically moveable base plates 79 and 80 are disposed such that the pegs 83 and 84 are placed in positions opposite to the two inner and outer bobbin hangers 5, respectively, the bobbin exchange arm assemblies 81 and 82 are then disposed at an advanced position shown in FIG. 3. Parenthetically, in FIG. 3, there are shown only the parts which are relevant to the bobbin exchange arm assembly 82. When the bobbin exchange arm assemblies 81 and 82 are disposed in the respective advanced positions, the pegs 83 and 84 assume the states in which they are opposite to the bobbin hangers 5 suspended on the roving bobbin rails. At this juncture, it should be mentioned that the pegs 83 and 84 are adapted to be rotated by electric motors 95 and 96, respectively, via belt transmission mechanisms (not shown).

Figure 13:
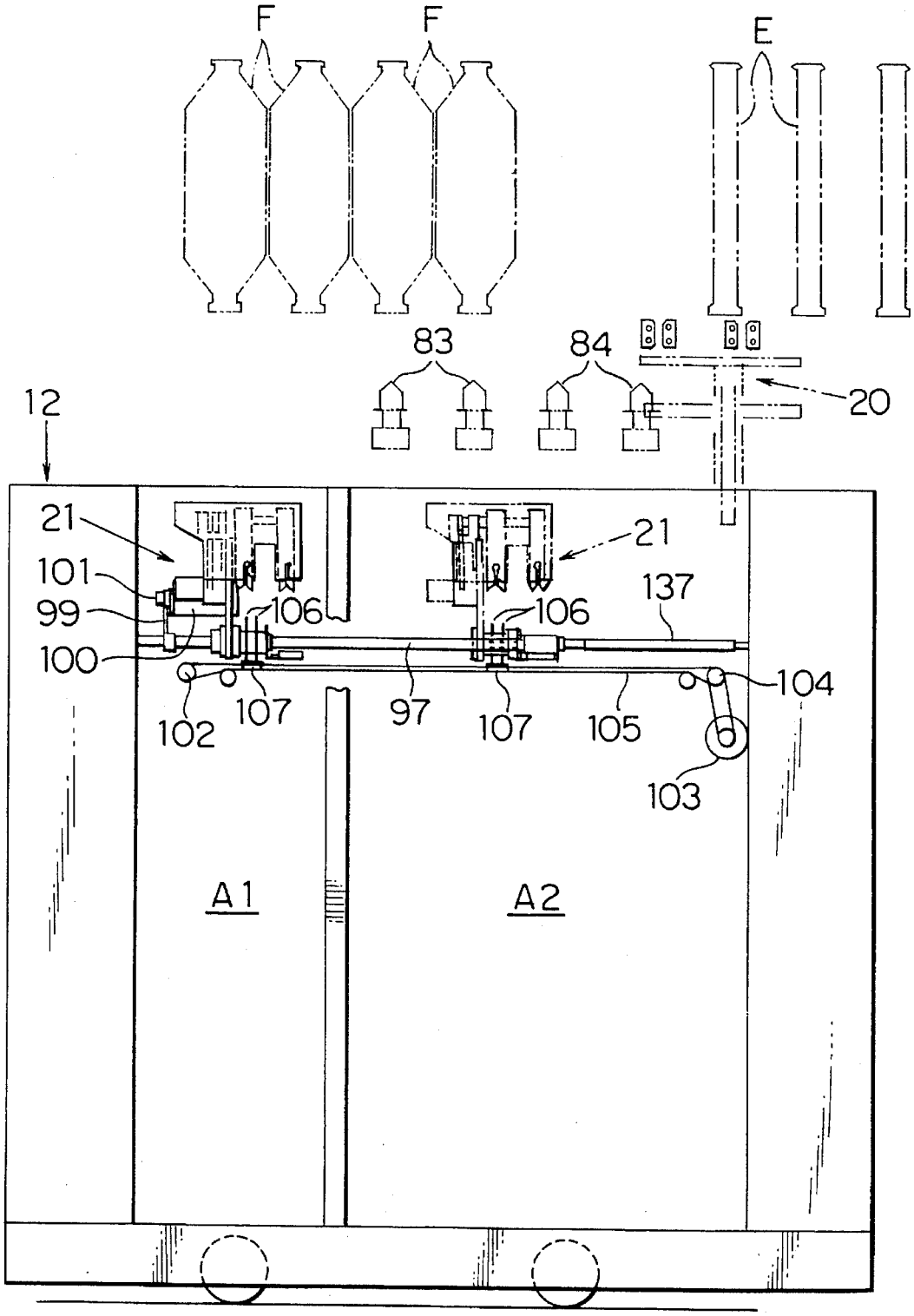
FIG. 13 is a schematic rear side elevational view of the roving bobbin changing apparatus and shows the structure of a mechanism for moving the apparatus.

Now, referring to FIGS. 1 and 2 along with FIG. 13, there is disposed at an upper front side portion of the roving bobbin changing apparatus 12 a rotatable shaft 97 which is constituted by a spline shaft and which extends in parallel with the moving direction of the roving bobbin changing apparatus 12 from the roving end finding/pick-up section A1 to a position corresponding to the full roving bobbin transfer mechanism 16 of the roving tying/bobbin exchange section A2. The roving tying mechanism 21 is so disposed as to be reciprocatively movable along the rotatable shaft 97 between the roving end finding/pick-up section A1 and the roving tying/bobbin exchange section A2 by actuating a driving means.

Supported on the rotatable shaft 97 is a supporting arm 98 (FIG. 8) of the roving tying mechanism 21 at a proximal end thereof so as to be rotatable in unison with the rotatable shaft 97 and slidably movable along the rotatable shaft 97. A driving means for moving the supporting arm 98 and hence the roving tying mechanism 21 between the roving end finding/pick-up section A1 and the roving tying/bobbin exchange section A2 as well as a mechanism for revolving the roving tying mechanism 21 between the roving tying position and the stand-by position are basically similar to those disclosed in Japanese Unexamined Patent Application Publication No. 127368/1990 (JP-A-H2-127368). As shown in FIGS. 1 and 3, a sector wheel 99 is fixedly secured to the rotatable shaft 97 at one end thereof so as to be rotatable together with the rotatable shaft 97. An arm driving electric motor 100 is installed above the rotatable shaft 97, wherein a pinion 101 mounted on the output shaft of the arm driving electric motor 100 meshes with the sector wheel 99. Thus, by driving the arm driving electric motor 100, the rotatable shaft 97 and the supporting arm 98 are rotated via the pinion 101 and the sector wheel 99. As a consequence, a roving tying head assembly PH supported by the supporting arm 98 at a distal end thereof can be revolved between the roving tying position located above the draft part 7 and a stand-by position where no obstacle is presented to the movement of the roving bobbin changing apparatus 12.

Disposed in the vicinity of a first end portion of the rotatable shaft 97 and at a rear end portion of the roving tying/bobbin exchange section A2 are a driven pulley 102 and a driving pulley 104 which are driven by an electric motor 103 for moving transversely the supporting arm, wherein a transmission belt 105 is spanned between and around the driven pulley 102 and the driving pulley 104 so as to extend in parallel with the rotatable shaft 97. An engaging member 107 secured to the transmission belt 105 can engage with a collar 106 projecting from a hub formed at a proximal end portion of the supporting arm 98. Thus, the supporting arm 98 can be moved between the roving end finding/pick-up section A1 and the roving tying/bobbin exchange section A2 along the rotatable shaft 97 through the medium of the engaging member 107 as the transmission belt 105 is moved. It will be appreciated that the rotatable shaft 97, the electric motor 103, the transmission belt 105, the engaging member 107 and others cooperate to constitute a driving means.

Figure 9:
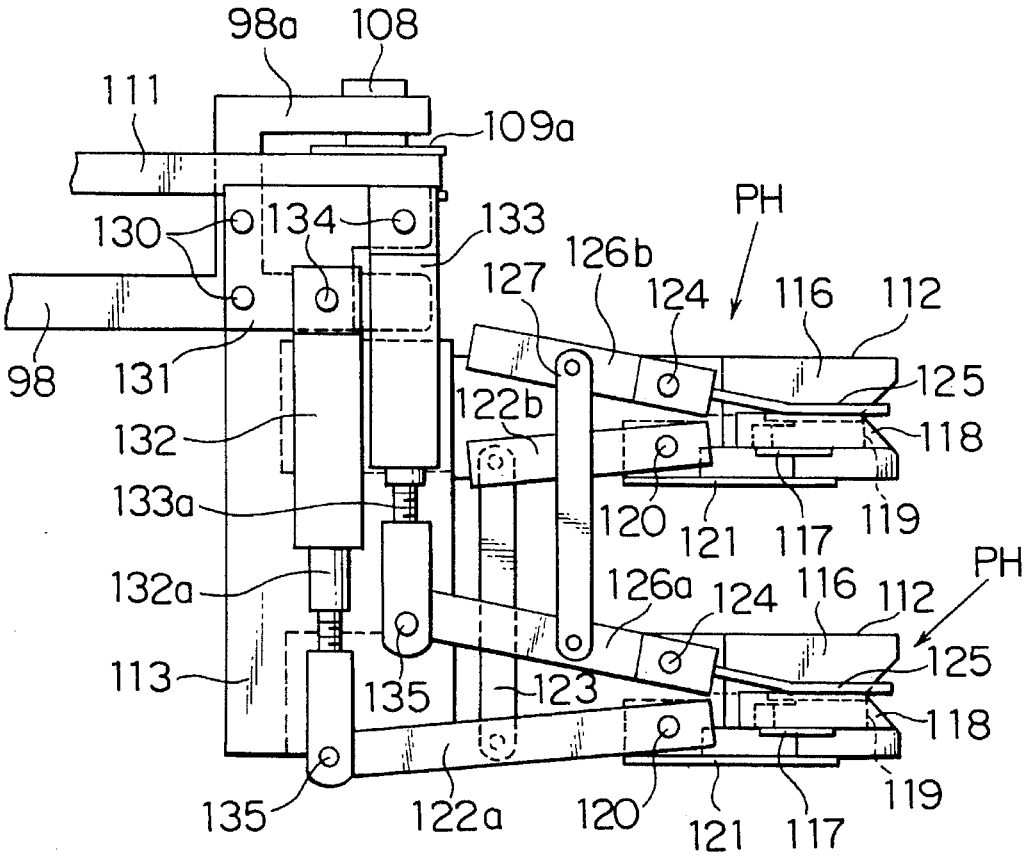
FIG. 9 is a top plan view showing structure of a roving tying head in the state where a cover is removed.

A mount 98*a* substantially of a U-like shape is formed in the distal end portion of the supporting arm 98 to support the rotatable shaft 108 in the state where the rotatable shaft 108 projects laterally from the mount 98*a*, as can be seen in FIG. 9. A toothed pulley 109*a* is fixedly secured to the rotatable shaft 108 at the position corresponding to the mount 98*a*, wherein a toothed belt 111 is spanned between the toothed pulley 109*a* and a toothed pulley 109*b* secured to a driving shaft of an electric motor 110 which in turn is fixedly mounted on the supporting arm 98 at a proximal end portion thereof. Further, the roving tying head assembly PH is fixedly mounted on the rotatable shaft 108 at a portion projecting laterally from the mount 98*a* so as to be rotatable together with the shaft 108. Thus, the roving tying head assembly PH can be revolved when the electric motor 110 is driven. Parenthetically, a variable-speed motor is employed as the motor 110.

Figure 8:
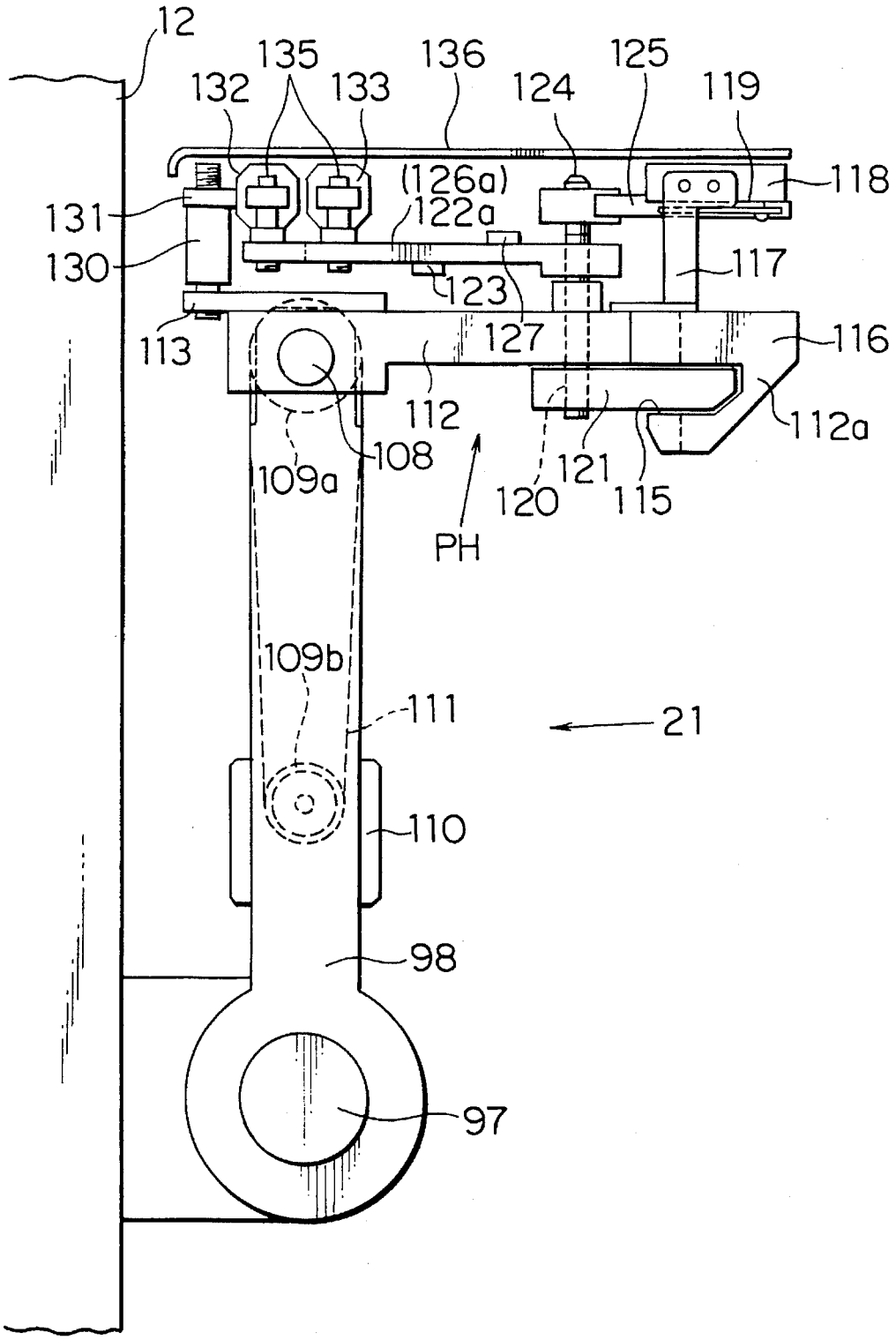
FIG. 8 is a side elevational view showing a roving tying mechanism.

The roving tying head assembly PH is so implemented as to service a pair of spindles. More specifically, a pair of roving tying head bodies 112 are snugly fitted on the rotatable shaft 108 so as to rotate in unison, as shown in FIGS. 8 and 9, and connected to each other by a connecting plate 113 so as to be maintained in a parallel relation. The connecting plate 113 has a first end portion extending to a position above the toothed pulley 109*a*.

Figure 10:
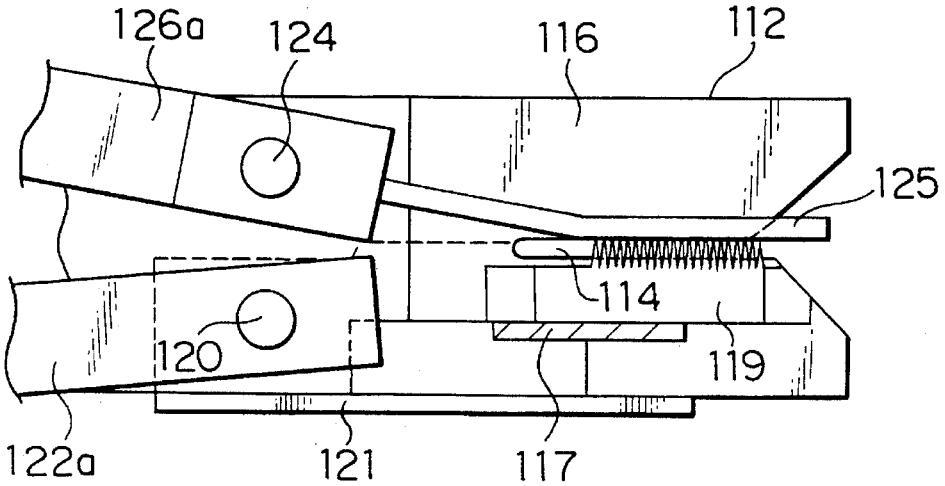
FIG. 10 is a fragmentary plan view showing exaggeratedly a portion of the roving tying head.

A projecting portion 112*a* having an inclined surface extending rearwardly and downwardly is formed in the roving tying head body 112 at a distal end portion thereof, which is formed in such a configuration as to be capable of entering the trumpet 8. A roving guide channel 114 (see FIGS. 10 and 11) is formed in the distal end portion of the roving tying head body 112 so as to extend vertically and longitudinally of the roving tying head body 112. A notch 115 is formed in the projecting portion 112*a* at one side thereof with reference to the roving guide channel 114. The notch 115 is communicated to the roving guide channel 114 to open it rearwardly and laterally.

A block 116 having the notch 115 is formed separately from the roving tying head body 112 and secured integrally to the roving tying head body 112 by screws or the like (not shown). An upwardly projecting supporting piece 117 is formed at a top surface of the block 116. Further, a roving guide block 118 is fixedly formed in the supporting piece 117 so as to extend along and above the roving guide channel 114. Secured fixedly by screws (not shown) to the roving guide block 118 is a comb member 119 which has a number of comb teeth formed internally therewith at a position to allow the preceding roving R1 to be introduced or led into the roving guide channel 114 from a front end thereof, wherein the tip ends of the comb teeth are uniformly arrayed along the direction longitudinal of the roving guide block 118.

Figure 11:
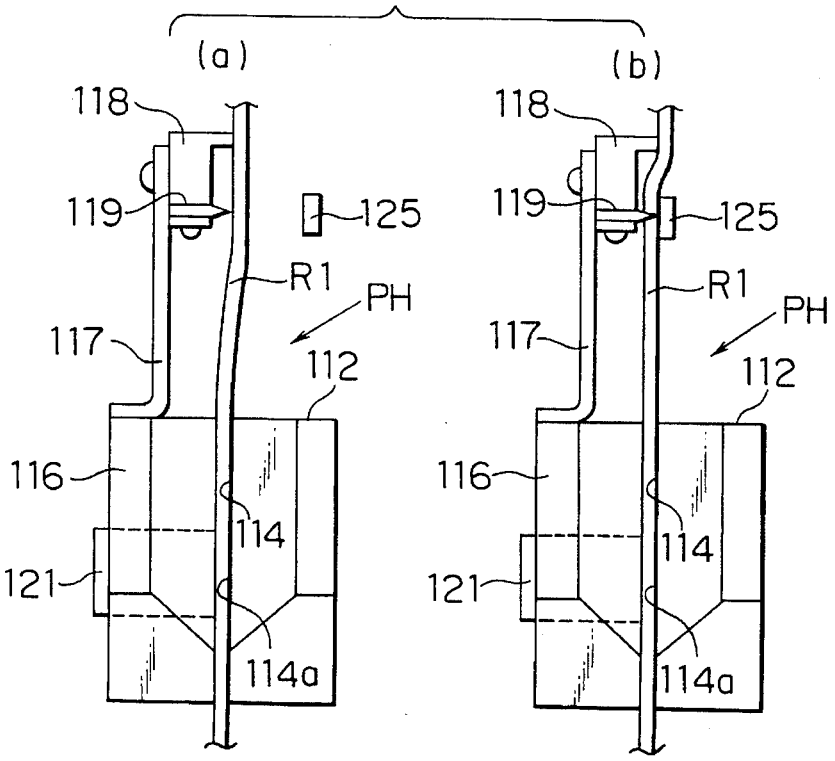
FIG. 11(*a*) is a fragmental front view for illustrating a positional relation between the roving tying head and a roving drawing member which is at a stand-by position.

As can be seen in FIG. 11, the comb member 119 is so disposed that the distal teeth ends thereof assume a position which corresponds substantially to the center of the roving guide channel 114. Further, a guide portion for engaging and guiding the preceding roving R1 upon introduction thereof into the roving guide channel 114 is formed at a top end of the roving guide block 118 in the form of a projection to above the roving guide channel 114. Thus, the guide portion serves to protect the preceding roving R1 from being trapped by the comb member 119 when the preceding roving R1 is introduced or led into the roving guide channel 114.

Mounted rotatably in both of the roving tying head bodies 112 at the rear side of the projecting portion 112*a* are supporting pins 120 in a state projecting beyond the upper and lower sides of the roving tying head bodies 112, respectively. At a lower end portion of each of the supporting pins 120, there is mounted a grasping member 121 at a proximal end thereof for gripping or grasping the succeeding roving R2 so as to be rotatable together with the supporting pin 120, while the distal end portion of the grasping member 121 is inserted into the notch 115. At top ends of both the supporting pins 120, there are fixedly mounted levers 122*a* and 122*b* rotatably together with the respective supporting pins 120 so as to extend along the longitudinal axes of the roving tying head bodies 112, respectively. The grasping member 121 is so disposed that the grasping portion thereof can be indexed to a roving grasping position at which the grasping portion enters the roving guide channel 114 and a stand-by position retracted from the roving guide channel 114 dependent upon the directions in which the associated supporting pin 120 is rotated. The grasping member 121 grasps the succeeding roving R2 through cooperation with one wall surface 114*a* of the roving guide channel 114*a* at the roving grasping portion, while in the stand-by state, the grasping member 121 allows the roving to be moved within the roving guide channel 114. Both of the levers 122*a* and 122*b* are connected to each other by means of a connecting bar 123 so as to be rotatable in unison.

Further mounted rotatably in the roving tying head body 112 at a lateral side of the supporting pin 120 is a supporting pin 124 which projects upwardly beyond the supporting pin 120. At a top end of the supporting pin 124, there is fixedly secured a roving drawing member 125 at a proximal end portion thereof, while there are secured at intermediate portions of the supporting pin 124 a pair of levers 126*a* and 126*b* at respective first ends thereof. The roving drawing member 125 and the levers 126*a* and 126*b* are rotatable in unison together with the supporting pin 124. The levers 126*a* and 126*b* are connected to each other by a link bar 127 so as to be rotatable as an integral unit. Depending upon on the rotation of the supporting pin 124, the roving drawing member 125 can be moved to a stand-by position where the preceding roving R1 is allowed to be led into the roving guide channel 114 and an operating position at which the roving drawing member 125 bears against the teeth tips of the comb member 119 (see FIG. 11 (*b*).

An upstanding supporting stud 130 is mounted on the connecting plate 113 at a first end portion thereof (close to the supporting arm 98), and a plate 131 is fixedly secured at the top end of the supporting stud 130. Supported on the plate 131 via a supporting shaft 134 and extending orthogonally to the roving tying head body 112 are air cylinders 132 and 133 at proximal ends thereof. The air cylinder 132 has a piston rod 132*a* connected pivotally to the second end portion of the lever 122*a* by means of a pivot pin 135. On the other hand, a piston rod 133*a* of the air cylinder 133 is pivotally connected to the second end portion of the lever 126*a* by means of the pivot pin 135. When the air cylinder 132 is actuated, the grasping member 121 is revolved through the medium of the levers 122*a* and 122*b*, while actuation of the air cylinder 133 brings about revolution of the roving drawing member 125 by way of the levers 126*a* and 126*b*.

A cover 136 is mounted on the roving tying head assembly PH by means of a mounting member (not shown) secured to the connecting plate 113 so as to enclose or cover the levers 122*a*, 122*b*, 126*a* and 126*b* and the air cylinders 132 and 133. The outlet of the trumpet 8 is realized in an elongated form which permits the succeeding roving R2 to pass therethrough while the preceding roving R1 being delivered is located within the trumpet 8.

The roving tying head assembly PH implemented in the structure described above performs grasp and release operations for the succeeding roving R2 and the preceding roving R1 in the manner which will be described below. The grasping member 121 is disposed at the stand-by position with the grasping portion thereof being withdrawn from the roving guide channel 114 when the piston rod 132*a* is at the retracted position. In this state, the succeeding roving R2 can be introduced into the roving guide channel 114 to a maximum extent.

Figure 12:
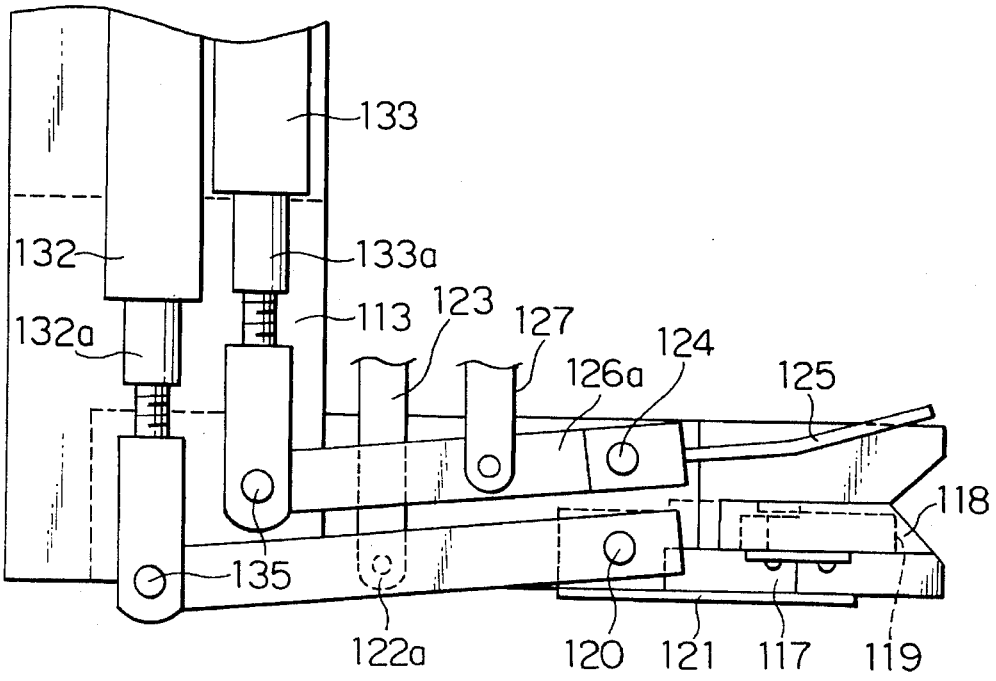
FIG. 12 is a partial plan view showing the roving tying head in the state in which the roving drawing member is disposed at the stand-by position.

When the piston rod 132*a* is extended outwardly, as shown in FIG. 12, the grasping portion is disposed at the roving grasping position at which the grasping portion is capable of grasping the roving through cooperation with the one wall surface 114*a* of the roving guide channel 114. In this state, the preceding roving R1 is retained at the tip or distal end of the grasping member 121 to be thereby prevented from moving further into the roving guide channel 114 from the roving grasping position. Thus, contact of the preceding roving R1 with the succeeding roving R2 is inhibited.

When the piston rod 133*a* is actuated to the outwardly projecting position, the roving drawing member 125 is positioned to the stand-by state where the roving drawing member 125 is located apart from the comb member 119, as can be seen in FIG. 11 (*a*). On the other hand, in the state where the piston rod 133*a* is retracted, the roving drawing member 125 is indexed to the operating position at which the roving drawing member 125 bears against the teeth of the comb member 119, as shown in FIG. 11 (*b*). When the preceding roving R1 is moved upon rotation of a back roller 7*a* of the draft part 7, a part of the fibers constituting the preceding roving R1 is prevented from moving through the comb member 119. As a result, a portion of the preceding roving R1 located at the draft part 7 becomes thinner than a portion of the preceding roving R1 located at the comb member 119. When the roving tying head assembly PH is revolved in the direction away from the trumpet 8 in this state, the preceding roving R1 can positively be broken or cut at the thinned portion with fibers being loosened off.

Figure 14:
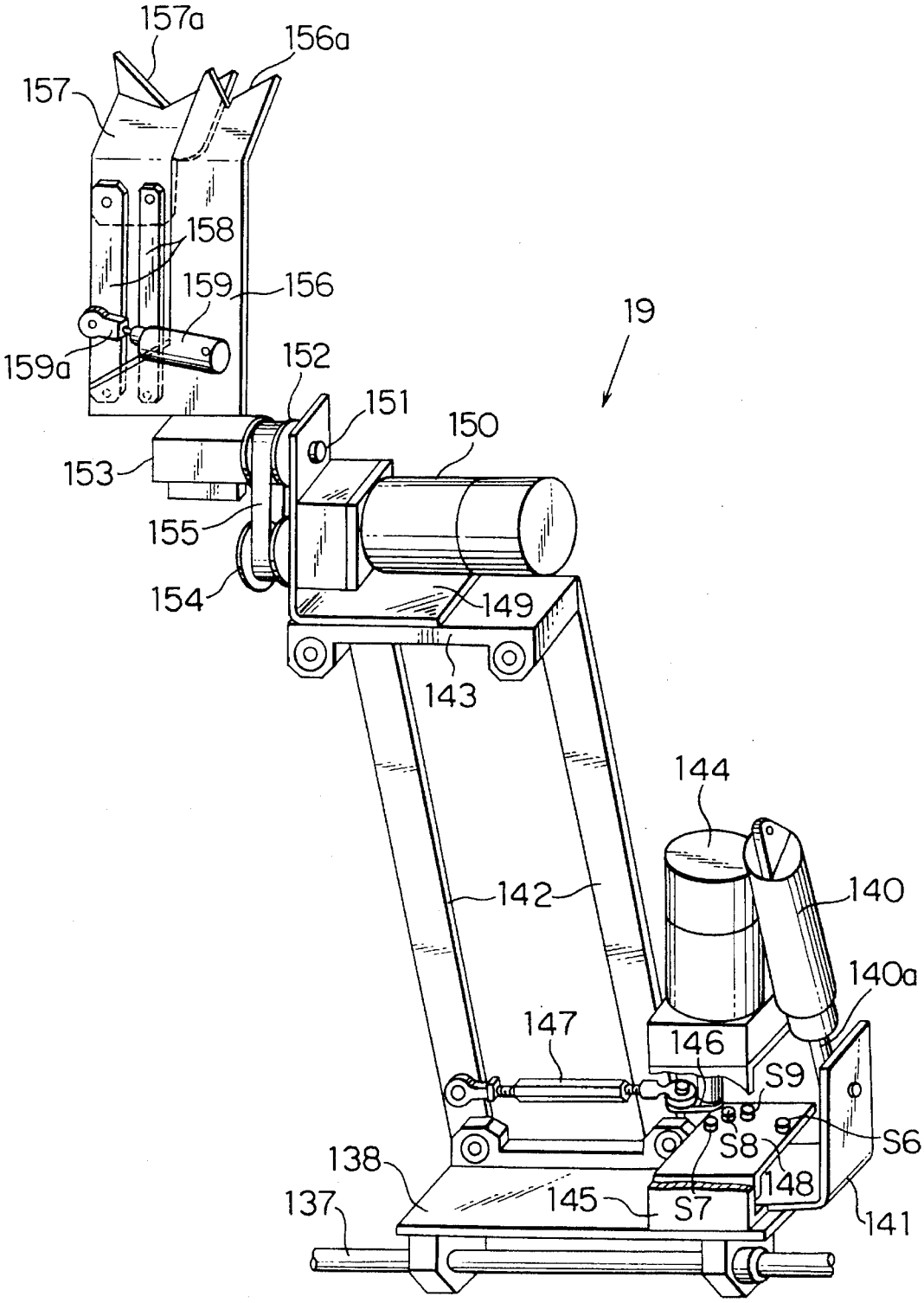
FIG. 14 is a perspective view showing a roving introducing and attaching mechanism.
Figure 16:
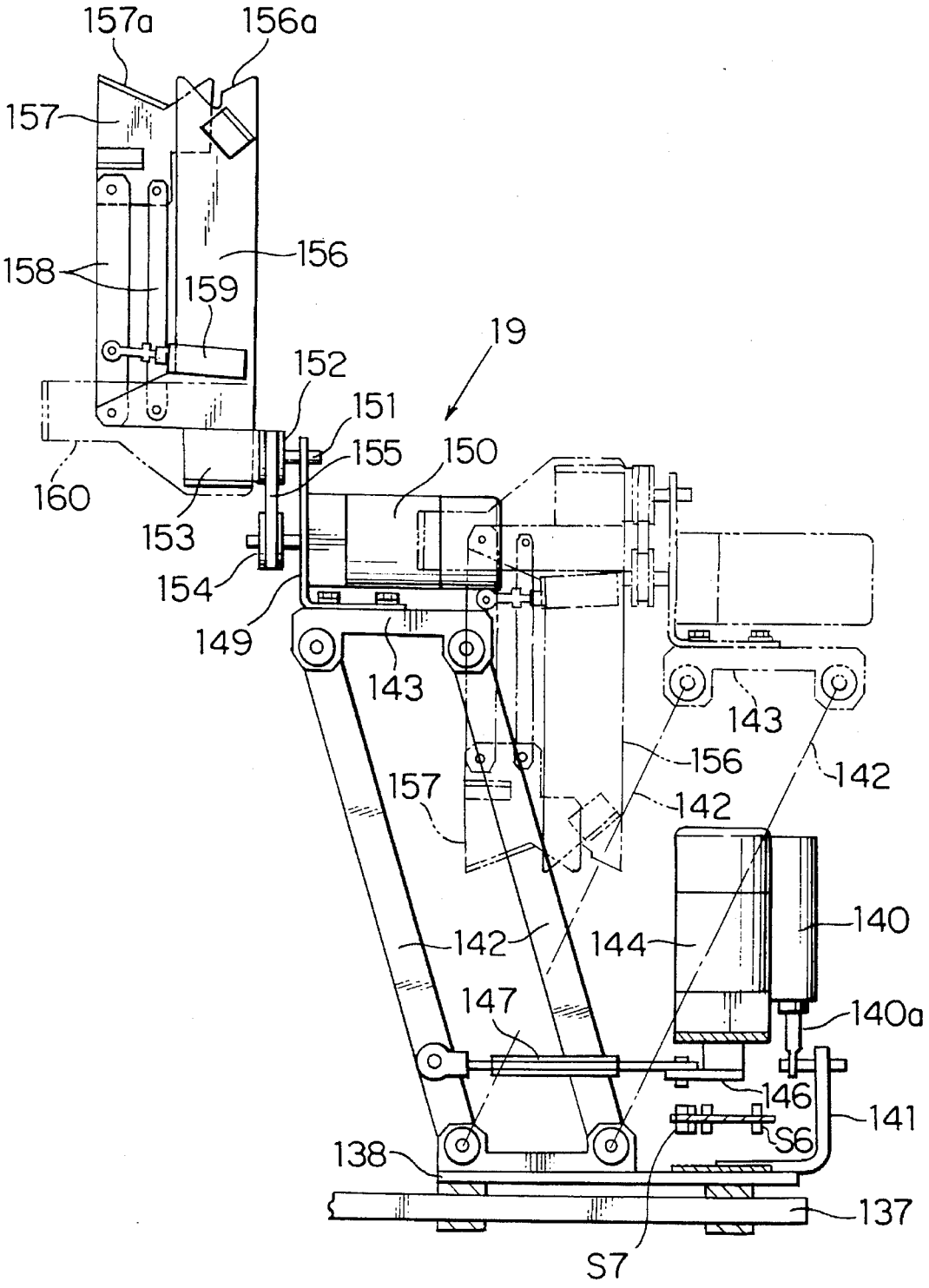
FIG. 16 is a rear side elevational view showing the same.

The roving attaching mechanism 19 is implemented in a structure similar to that disclosed in Japanese Unexamined Patent Application Publication No. 132826/1993 (JP-A-H5-132826) filed by the same assignee as the present application. The roving attaching mechanism 19 is disposed at a trailing position as viewed in the direction in which the roving changing operation, performed by the roving bobbin changing apparatus 12, progresses. As can be seen in FIGS. 2, 13 and 15, a supporting shaft 137 is disposed at the front side of the roving bobbin changing apparatus 12 and extends collinearly with the rotatable shaft 97. Supported rotatably on the supporting shaft 137 is a base plate 138 of the roving attaching mechanism 19, as shown in FIGS. 14, 15 and 16. Further, a proximal end portion of an air cylinder 140 is pivotally connected to a bracket 39 which is secured to an upper front frame portion of the roving bobbin changing apparatus 12. The air cylinder 140 has a piston rod 140*a* which is pivotally connected to a bracket 141 by a pin, the bracket 141 being fixedly secured to a top surface of the base plate 138, so that when the piston rod 140*a* is in the retracted state, the base plate 138 is held horizontally, while when the piston rod 140*a* is extended, the base plate 138 assumes a posture inclined frontwards.

Next, referring to FIG. 14 and 16, it will be seen that a supporting plate 143 is disposed above the base plate 138 so as to be movable along the longitudinal axis of the roving bobbin changing apparatus 12 through the medium of a four-joint linkage 142 disposed on the base plate 138. An electric reversible motor 144 equipped with a brake is fixedly mounted on the base plate 138 by means of a supporting bracket 145. The reversible motor 144 has a driving shaft on which a lever 146 is mounted to be rotatable with the former, while the lever 146 and the four-joint linkage 142 are connected to each other by means of a connecting rod 147. The driving shaft of the reversible motor 144 is rotated over a substantially predetermined angular range with the supporting plate 143 moving in parallel to the supporting shaft 137 in accompanying the rotation of the driving shaft. Further, a mounting plate 148 is secured to the supporting bracket 145 in a horizontal orientation below the lever 146 and provided with four sensors S6 to S9 which are adapted to detect the lever 146 when a roving guide mentioned later on is disposed at a stand-by position, a roving take-up position, a roving guide insert position and a roving attachment completed position, respectively.

A reversible motor 150 equipped with a brake is fixedly mounted on a supporting bracket 149 in parallel thereto. The supporting bracket 149 in turn is fixedly mounted on the upper surface of the supporting plate 143. A supporting shaft 151 is fixedly disposed above the reversible motor 150, and a toothed pulley 152 and a supporting block 153 are rotatably supported on the supporting shaft 151. The toothed pulley 152 is secured to the supporting block 153 by bolts (not shown) so as to be rotatable together. A toothed belt 155 is spanned between and around a toothed pulley 54 secured to the driving shaft of the reversible motor 150 and the toothed pulley 152.

Secured to the supporting block 153 is a stationary roving guide 156 at a proximal end thereof. Supported on the stationary roving guide 156 is a movable roving guide 157 by a pair of links 158 so as to be movable in parallel with the supporting shaft 137 when an air cylinder 159 supported on the stationary roving guide 156 is actuated. Both the stationary roving guide 156 and the movable roving guide 157 are formed with V-like guide grooves 156*a* and 157*a* at distal ends, respectively. In the state in which a piston rod 159*a* is retracted, the movable roving guide 157 is disposed at the roving attaching position where the distance between the V-like guide grooves 156*a* and 157*a* corresponds to a distance between a pair of openings formed in the roving guide 6. On the other hand, in the state where the piston rod 159*a* projects outwardly, the movable roving guide 157 is disposed at the roving take-up position where the distance between the V-like guide grooves 156*a* and 157*a* is increased.

Further, both the stationary roving guide 156 and the movable roving guide 157 are adapted to be driven and rotated together with the supporting block 153 around the supporting shaft 151 by the reversible motor 150 to thereby assume a stand-by position, an intermediate position and a roving attaching position, respectively. Operation of the reversible motor 150 is stopped in response to detection signals outputted from three sensors (not shown) mounted on the supporting bracket 149. Furthermore, a cover 160 is mounted on the supporting block 153 in such a manner as shown in FIG. 16 for the purpose of preventing the succeeding roving R2 from becoming tangled in the link 158 in the course of moving of the succeeding roving R2 in accompanying the movement of the movable roving guide 157.

Figure 17:
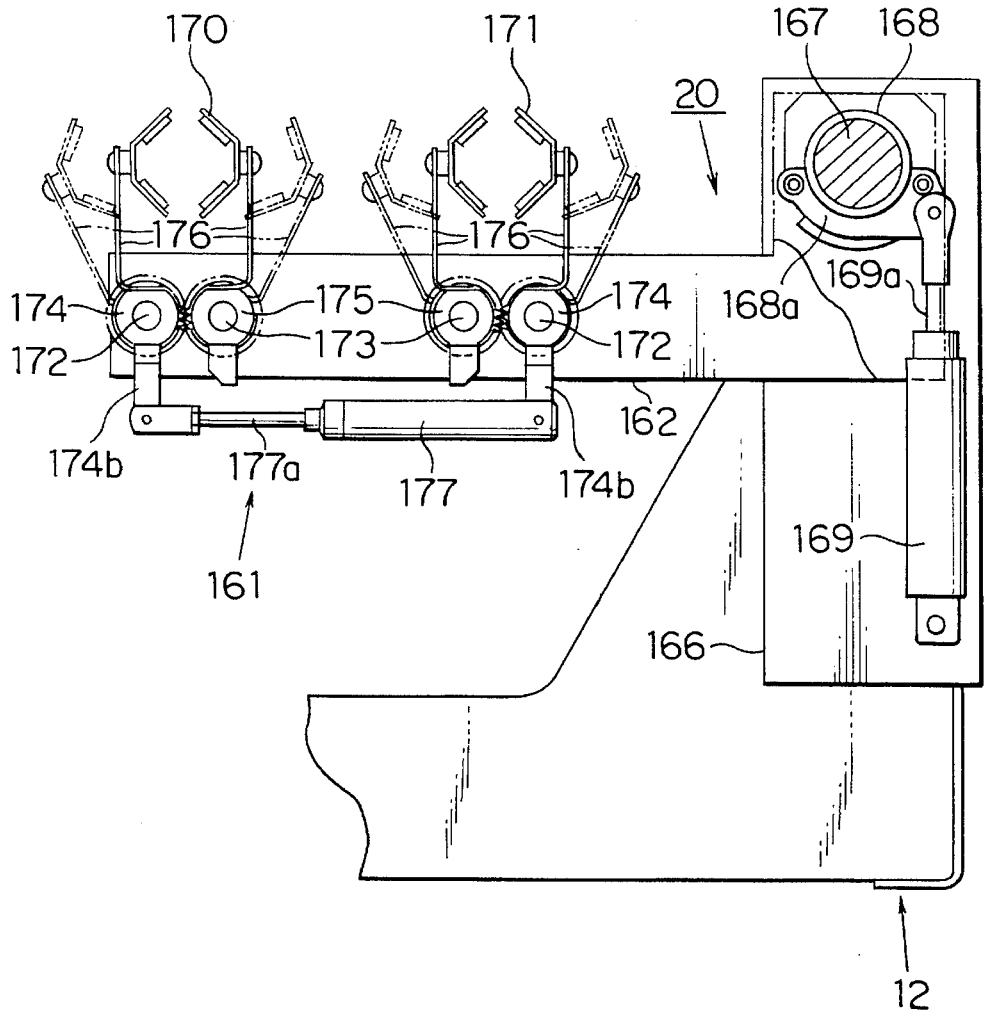
FIG. 17 is a partially broken plan view showing a bobbin holding mechanism.
Figure 19:
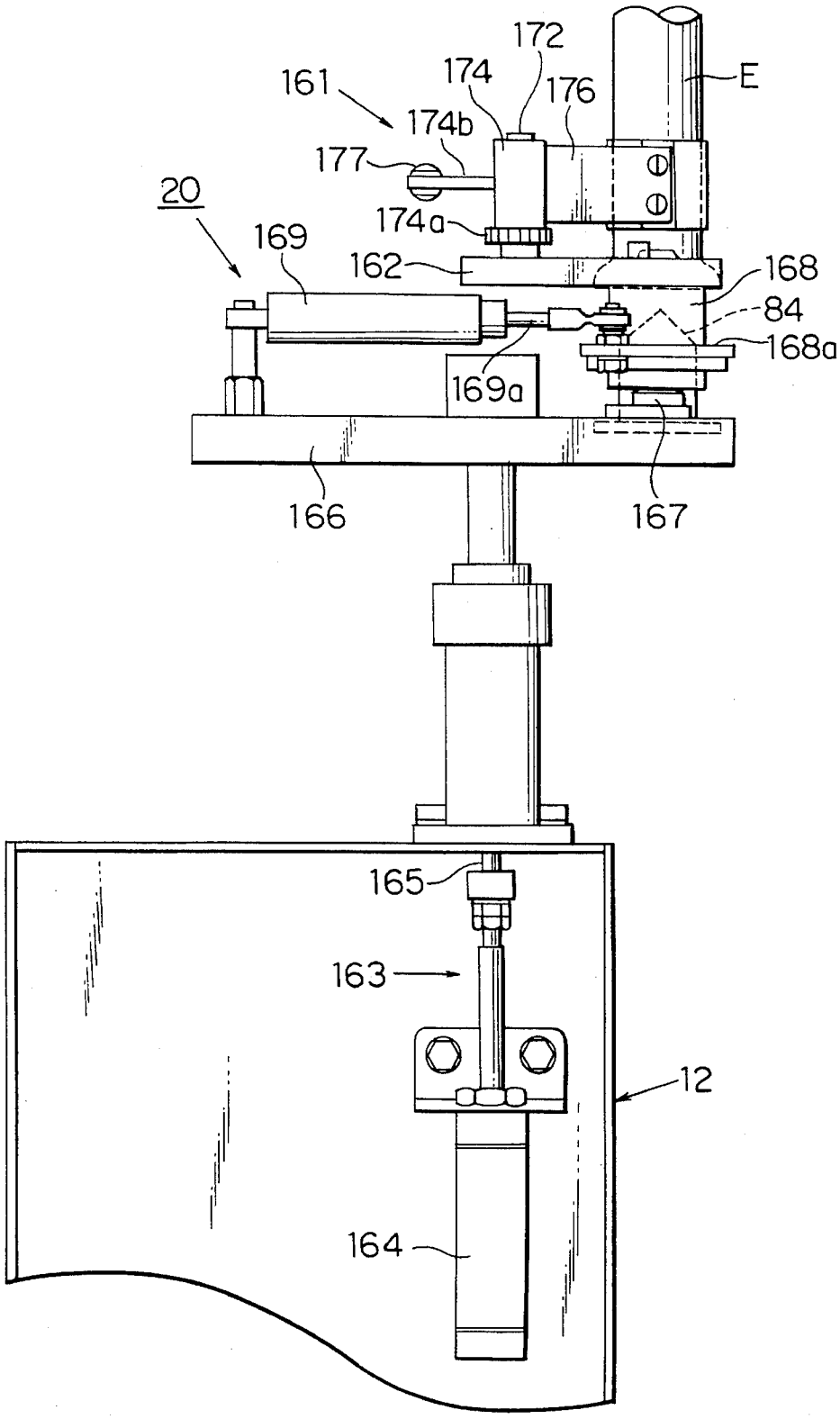
FIG. 19 is a side elevational view showing the same.
Figure 21:
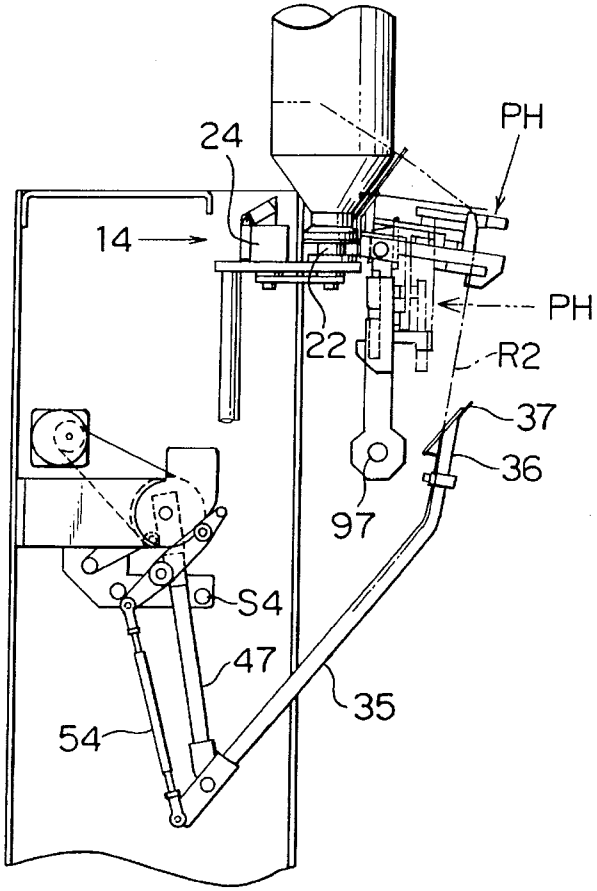
FIG. 21 is a side elevational view for illustrating operation of the roving end finding/pick-up mechanism at another operation stage.

Referring to FIGS. 17 and 19, the roving-depleted bobbin holding mechanism 20 is comprised of a bobbin grasping mechanism 161 adapted for grasping a pair of roving-depleted bobbins E, a horizontally rotatable supporting arm 162 revolved in a horizontal plane at the level of the bobbin grasping mechanism 161 and a lift mechanism 163 for vertically displacing (i.e., lifting and lowering) the supporting arm 162.

The lift mechanism 163 is adapted to be moved vertically along a ball spline 165 by means of an air cylinder 164, and a supporting plate 166 is fixedly mounted on the top end of the ball spline 165 in a horizontal disposition. A supporting cylindrical member 168 is rotatably supported on an upstanding supporting column 167 mounted on the upper surface of the supporting plate 166, and the supporting arm mechanism 162 is fixedly secured to the supporting cylindrical member 168 at the top end thereof in a horizontal orientation so as to be rotatable together with the supporting cylindrical member 168. Disposed on the supporting plate 166 is an air cylinder 169 of which piston rod 169*a* is connected to a collar 168*a* of the supporting cylindrical member 168. This member 168 is rotated by the air cylinder 169. When the piston rod 169*a* assumes a retracted position, the supporting arm 162 is disposed at a bobbin transfer position shown in FIG. 17, while when the piston rod 169*a* is extended, the supporting arm 162 is disposed at a stand-by position shown in FIG. 2.

Figure 18:
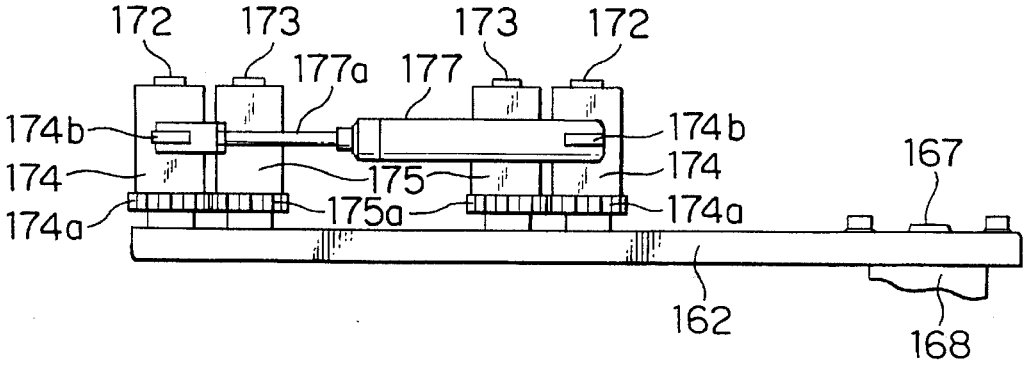
FIG. 18 is a rear side elevational view showing the same.

Next referring to FIGS. 17 to 19, it will be seen that the bobbin grasping mechanism 161 is disposed on the horizontally rotatable supporting arm 162 and provided with a pair of grasping tools disposed with the same pitch as that of the bobbin hangers 11*a* suspended on the bobbin carriage 11, as well as a pair of upstanding supporting studs 172 and 173 mounted on the horizontally rotatable supporting arm 162 at a predetermined distance, with supporting members 174 and 175 rotatably supported on the supporting studs 172 and 173, respectively. Formed integrally with a lower portion of each of the supporting members 174 and 175 are toothed wheels 174*a* and 175*a* which mesh with each other.

Each of the supporting members 174 and 175 is provided at a front side thereof with a gripping member 176 which is adapted to assume a position facing oppositely to the bobbin hanger 11*a* of the bobbin carriage 11 in the state where the horizontally rotatable supporting arm 162 is disposed at the bobbin transfer position shown in FIG. 17. Further, a supporting piece 174*b* projecting horizontally is formed integrally with each of the supporting members 174 at a rear side thereof, and an air cylinder 177 is disposed between both the supporting members 174*b* so as to extend in parallel with the longitudinal axis of the horizontally rotatable supporting arm 162. When the piston rod 177*a* of the air cylinder 177 is extended and retracted, the supporting members 174 and 175 are rotated in the directions opposite to each other, whereby the associated gripping member is caused to move between the grasping position and the releasing position.

Next, referring to FIGS. 20 to 39, description will turn to the roving bobbin changing operation performed by the roving bobbin changing apparatus 12 of the structure described above. Incidentally, in each of FIGS. 24 (*a*) to FIG. 35 (*a*), there is shown at the right-hand side a plan view for illustrating positional relations between the full roving bobbins F and the roving-depleted bobbins E in each operation stage and the creel 2, while there are schematically illustrated in FIGS. 24 to 35 at (b) the roving end finding/pick-up section A1 in an elevational side view, with the roving tying/bobbin exchange section A2 being schematically illustrated at (c) in each of FIGS. 24 to 35.

In the spinning machine 1, the spinning operation is started in the state where sets of the full roving bobbins F and sets of partially-exhausted bobbins M are alternately suspended on the roving bobbin rails 3 in the longitudinal directions thereof. At the time point when the partially-exhausted bobbins M become the roving-depleted bobbins E which are approaching the empty state while the full roving bobbins F are being concurrently consumed to the state of the partially-exhausted bobbins M, the roving changing operation is then performed. At this time point, the roving bobbin changing apparatus 12 is moved from one end of the machine frame to a first work position. In this case, the full roving bobbin support/lift mechanism 14 in the roving end finding/pick-up section A1 assumes a position for handling the full roving bobbins F suspended on the bobbin hanger 11*a*. Subsequently, the full roving bobbin support/lift mechanism 14 is actuated, whereby the supporting platform 23 is moved vertically, and the full roving bobbins F are taken out from the bobbin hangers 11*a* to be received and supported on the pegs 22 of the supporting platform 23.

Figure 20:
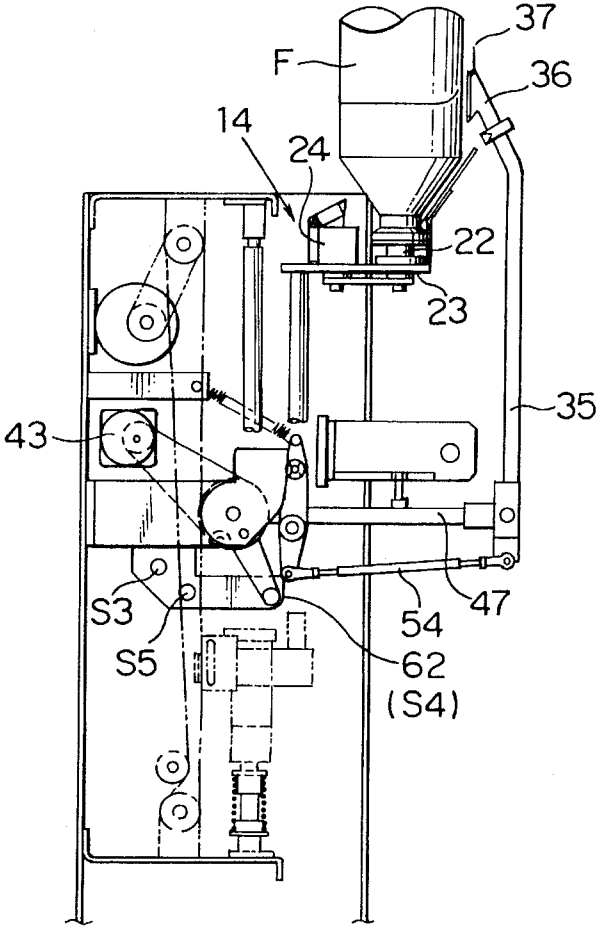
FIG. 20 is a side elevational view for illustrating operation of a roving end finding/pick-up mechanism at an operation stage.
Figure 22:
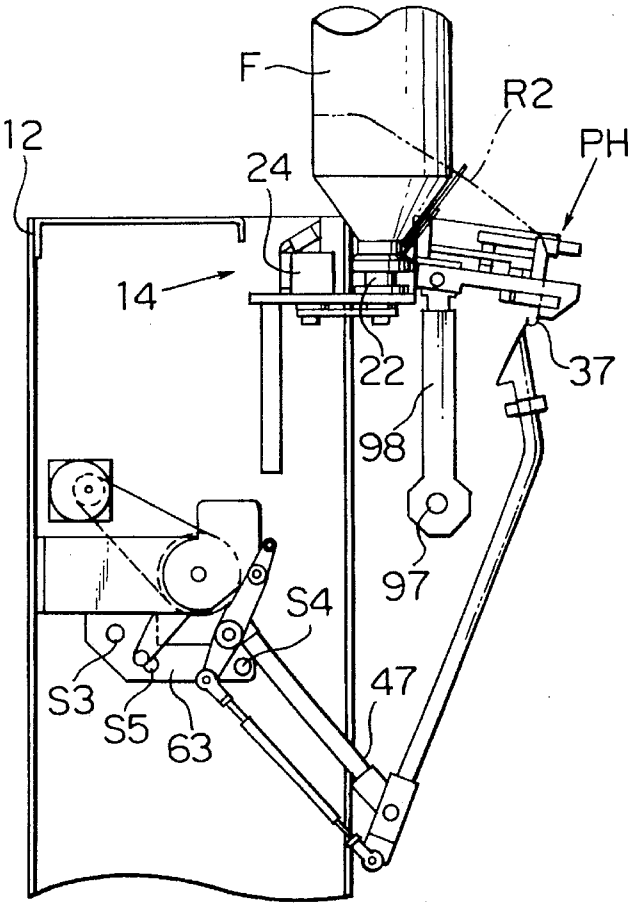
FIG. 22 is a side elevational view for illustrating operation of the roving end finding/pick-up mechanism in yet another state.

Simultaneously with the start of the roving changing operation, the blower 34 is driven, which results in a negative pressure (vacuum) within the roving chip collecting box 33. In succession, the electric motor 43 of the roving end finding/pick-up mechanism 15 is driven, whereby the suction nozzles 36 are vertically moved from the stand-by position shown in FIG. 4 to the roving end finding/pick-up position located in the vicinity of the bottoms of the full roving bobbins F, as shown in FIG. 20. Then, the electric motor 24 is driven to rotate the full roving bobbins F together with the pegs 22 more than one complete rotation, preferably, about one and a half rotations, in the direction in which,the succeeding roving R2 is delivered. During the rotation of the full roving bobbins F, the roving ends will reach positions close to the inlet ports of the suction nozzles 36 and then the roving end portions are sucked into the suction nozzles 36.

After rotation of the full roving bobbins F for the predetermined angular distance, the electric motor 43 is driven in the reverse or backward direction, whereby the supporting arm 47 is caused to revolve in the clockwise direction as viewed in FIG. 20. Thus, the suction nozzles 36 are lowered while sucking therein the succeeding rovings R2. At that time, the full roving bobbins F are rotated in the roving delivering direction at a speed corresponding to that at which the suction nozzles 36 are vertically moved downwardly, whereby the rovings are withdrawn from the full roving bobbin F accompanying the downward movement of the suction nozzles 36 without being broken. When the first sensor S3 detects the projection 62, the electric motor 43 is stopped with the suction nozzles 36 being settled at the position shown in FIG. 21. Thus, the roving end finding/pick-up operation comes to an end. This state corresponds to that shown in FIG. 29 (*b*).

Next, the electric motor 103 for moving the supporting arm transversely is driven in the forward direction. As the transmission belt 105 is moved in the corresponding direction, the roving tying mechanism 21 is moved to the roving end finding/pick-up section A1 from the roving tying/bobbin exchange section A2. The roving tying mechanism 21 is stopped at a position where the roving tying head assembly PH has reached a position close to the suction nozzle 36. Thus, the state indicated by phantom lines in FIG. 21 and illustrated in FIG. 30 (*b*) is established. Subsequently, the electric motor 110 is driven in the forward direction, whereby the roving tying head assembly PH is revolved in the counterclockwise direction with the grasping member 121 and the roving drawing member 125 being disposed in the release position. The roving tying head assembly PH thus reaches an approximately horizontal disposition indicated by solid lines in FIG. 21. In the course of revolution of the roving tying head assembly PH, the succeeding rovings R2 are introduced into the roving guide channel 114. Subsequently, the grasping member 121 is disposed at the roving grasping position to allow the succeeding rovings R2 extending from the full roving bobbins F to the suction nozzles 36 to be grasped by the roving tying head assembly PH.

Figure 23:
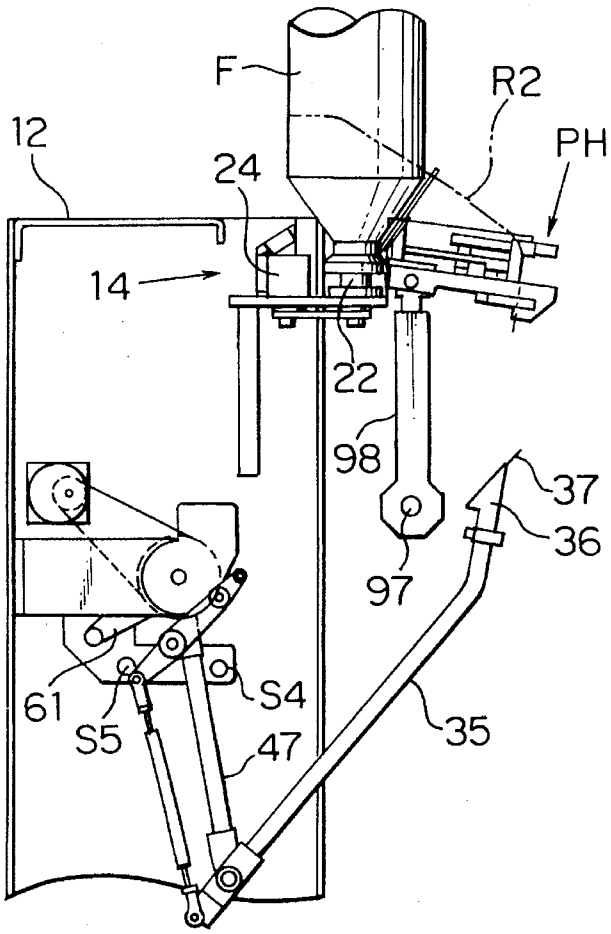
FIG. 23 is a side view for illustrating operation of the roving end finding/pick-up mechanism in a further state.
Figure 24:
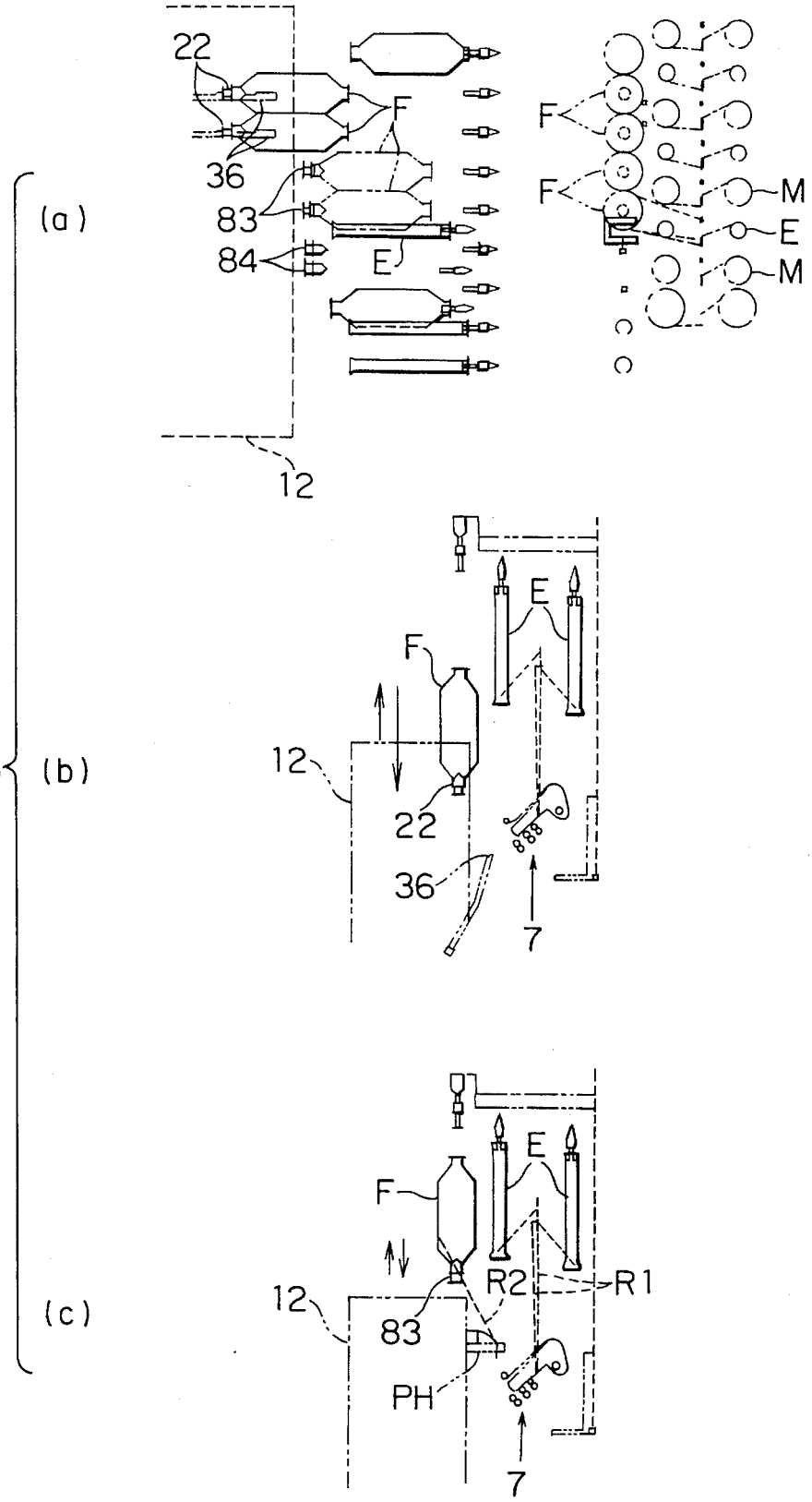
FIGS. 24(*a*) to (*c*) are views for illustrating the roving changing operation performed by a roving bobbin changing apparatus in a first operation phase.
Figure 25:
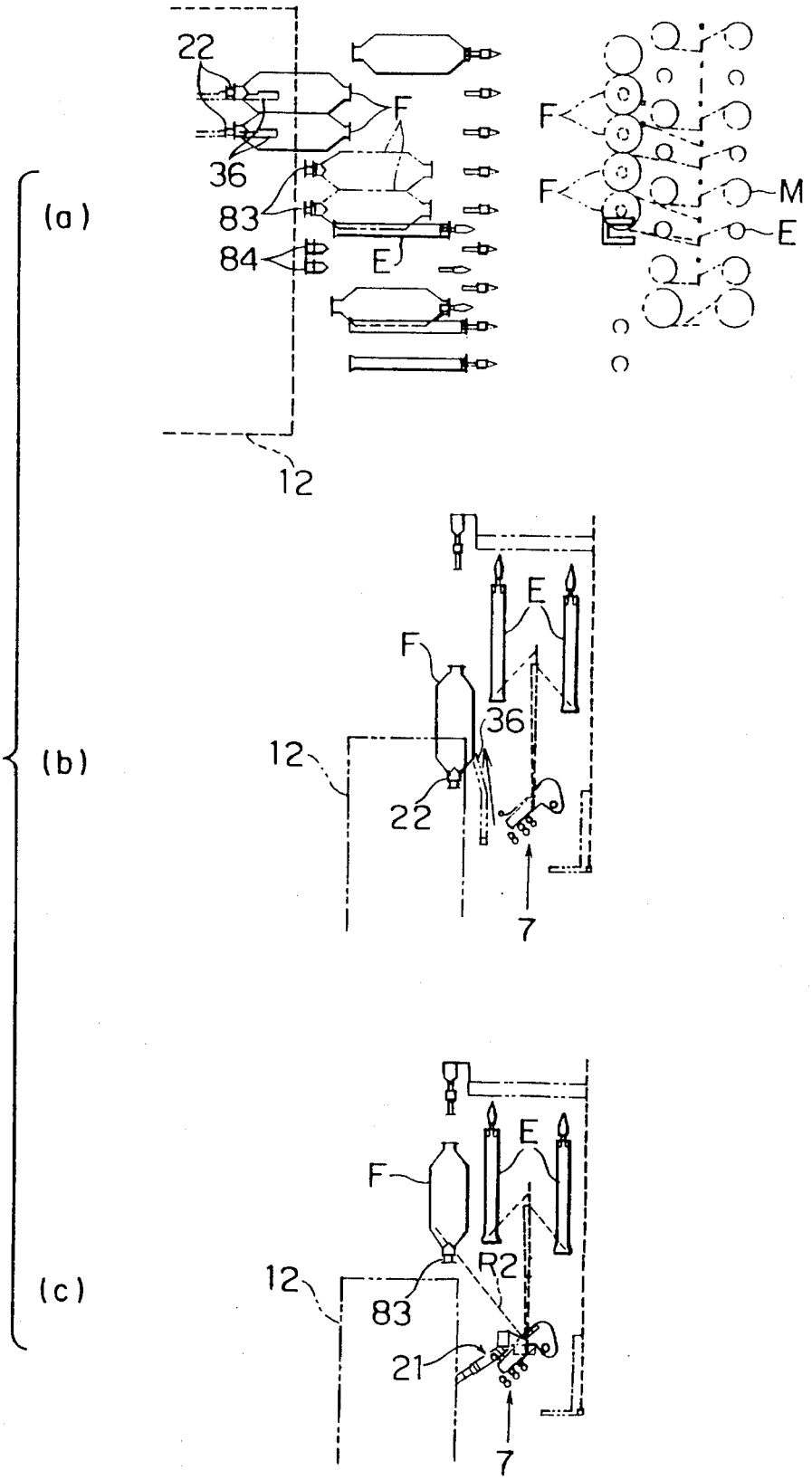
FIGS. 25(*a*) to (*c*) are views for illustrating the roving changing operation performed by the roving bobbin changing apparatus in a second operation phase.

Next, the electric motor 43 is driven in the forward direction until the suction nozzles 36 are moved upwardly to a position located in the vicinity of the roving tying head assembly PH. When the third sensor S5 disposed between the first and second sensors S3 and S4 detects the mark projection 62, the motor 43 is first stopped. Thereafter, the electric motor 43 is driven in the reverse direction, as a result of which the suction nozzles 36 are again set to the stand-by position. In the course of downward movement of the suction nozzles 36, the top end of the roving cutting member 37 and the engaging member 37*a* cooperate to cut the succeeding rovings R2 at a position between the roving cutting member 37 and the roving tying head assembly PH, as shown in FIG. 23. Thus, the state shown in FIG. 33(*b*) is established. The roving end portions resulting from the cutting are collected into the roving chip collecting box 33 by way of suction pipe 35, the supporting pipe 48 and the connecting pipe 49.

Figure 34:
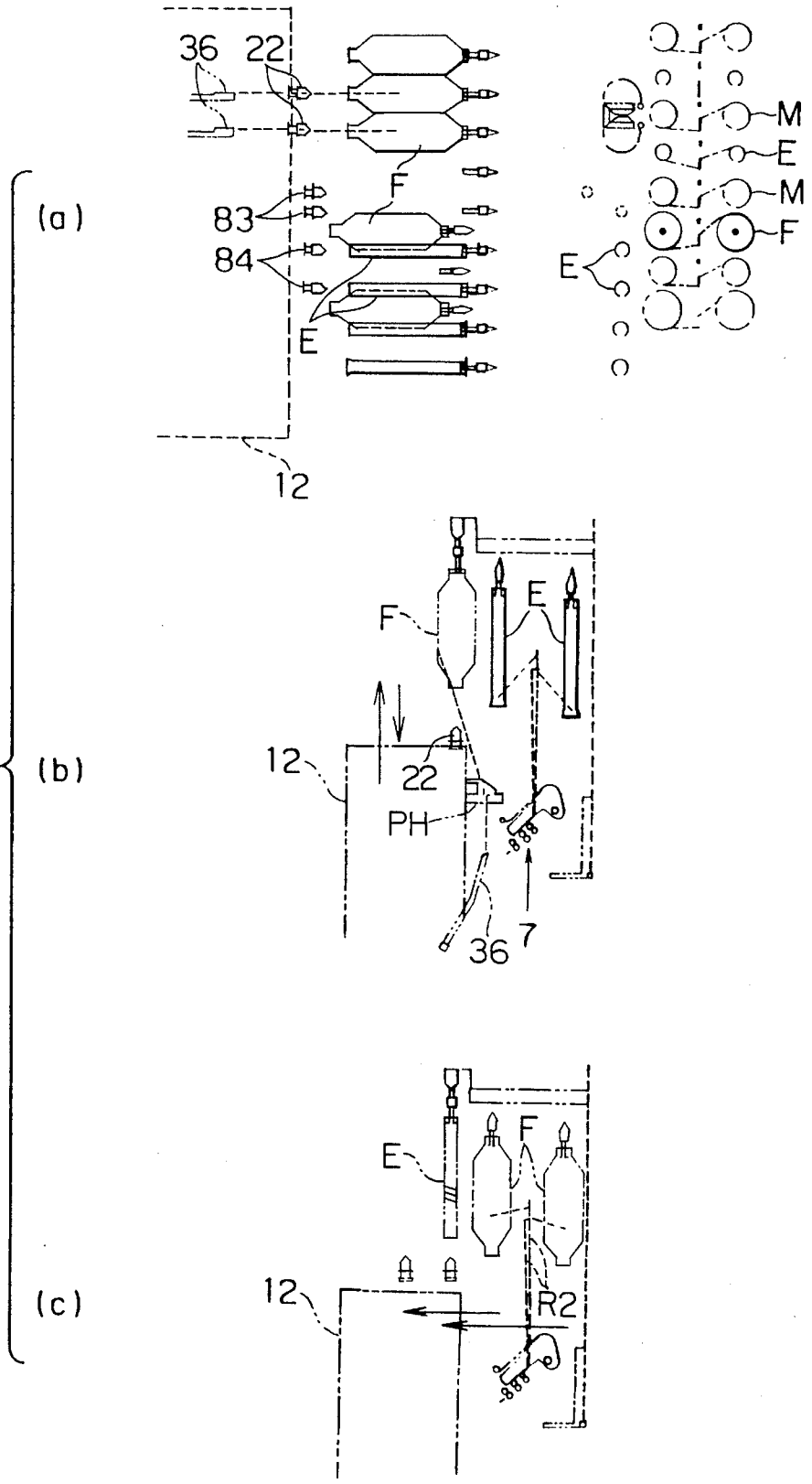
FIGS. 34(*a*) to (*c*) are views for illustrating the roving changing operation performed by the roving bobbin changing apparatus in an eleventh operation phase.

Subsequently, the electric motor 31 of the full roving bobbin support/lift mechanism 14 is driven to cause the supporting platform 23 to move upwardly, whereupon the full roving bobbins F are again suspended on the bobbin hangers 11*a* from which the full roving bobbins F have been removed, as shown in FIG. 34(*b*). Thus, the roving end finding/pick-up operation comes to an end. In this conjunction, it should be noted that the phrase "roving end finding/pick-up operation" means in the strict sense the operation involved until the roving ends have been found and picked up (the state shown in FIG. 29(*b*)). However, in order to carry out the roving tying operation, it is necessary that the roving ends are grasped by the roving tying head assembly PH. Accordingly, the roving end finding/pick-up operation means the process effected until the roving end grasping operation of the roving tying head assembly PH has been completed.

Figure 35:
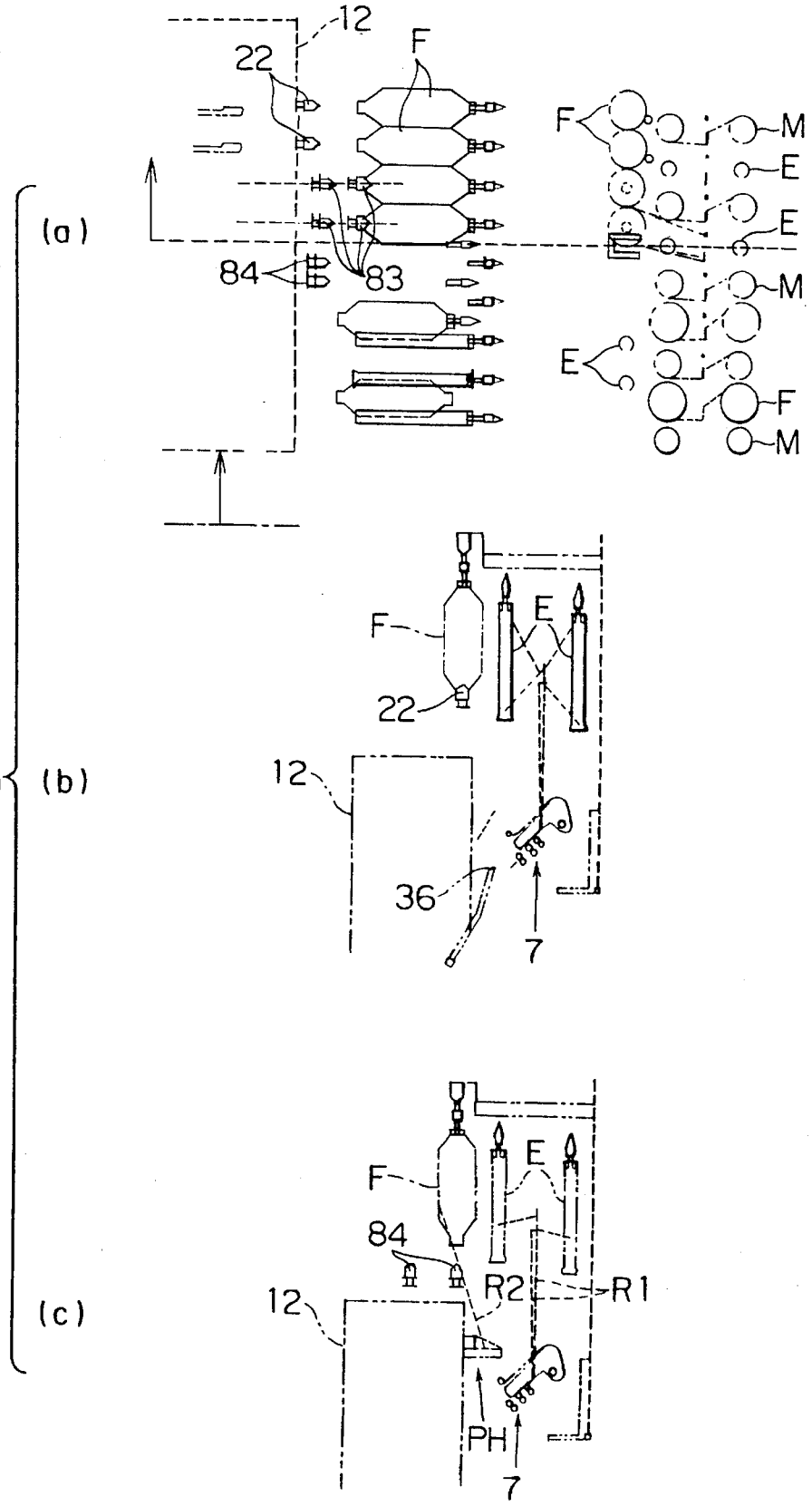
FIGS. 35(*a*) to (*c*) are views for illustrating the roving changing operation performed by the roving bobbin changing apparatus in a twelfth operation phase.
Figure 36:
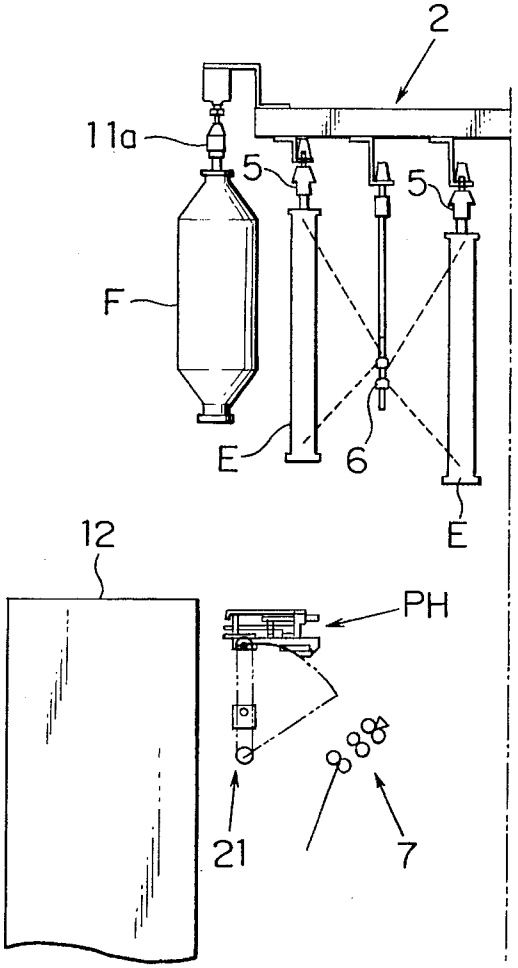
FIG. 36 is a schematic side elevational view showing the roving tying mechanism disposed in a state for the roving tying operation.
Figure 37:
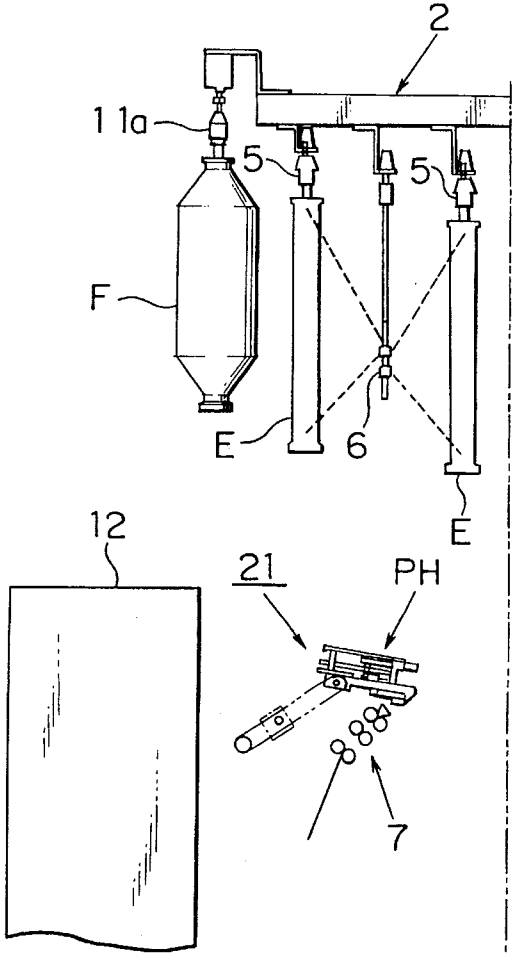
FIG. 37 is a schematic side elevational view showing the roving tying head disposed in the state for effecting a roving tying operation.
Figure 38:
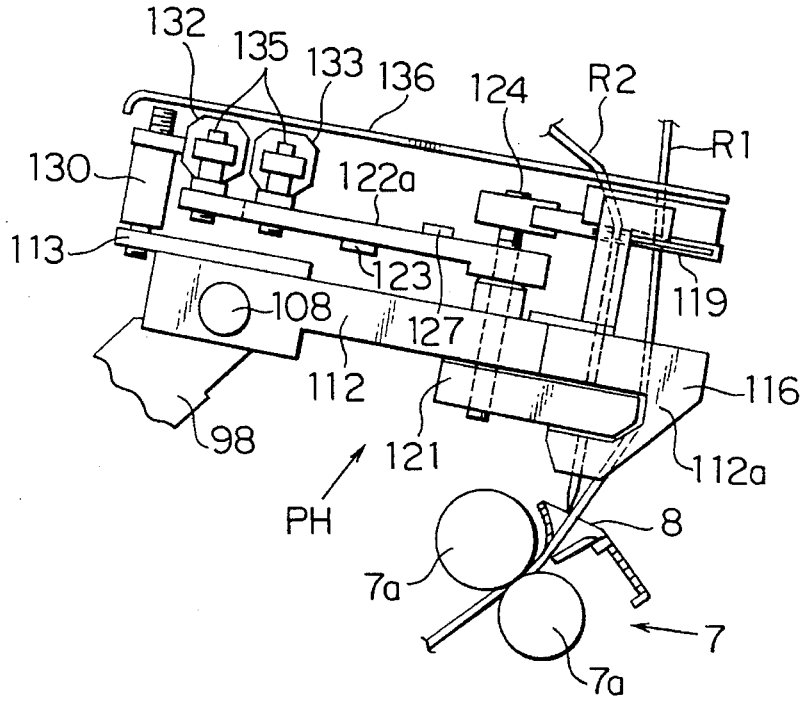
FIG. 38 is a schematic side elevational view showing the roving tying head disposed in another state for the roving tying operation.

Starting from the state described above, the roving bobbin changing apparatus 12 is moved along the machine frame until the roving bobbin changing apparatus 12 comes to a position corresponding to the full roving bobbins F for which next roving end finding/pick-up operation is required in the roving end finding/pick-up section A1, as shown in FIG. 35(*a*). In this position, the pegs 83 of the full roving bobbin transfer mechanism 16 are set to the state corresponding to the full roving bobbins F suspended on the bobbin hanger 11*a* and having the roving ends as found.

Subsequently, in the roving end finding/pick-up section A1, operations similar to those described previously are started. On the other hand, in the roving tying/bobbin exchange section A2, the roving tying or connecting operation is started by the roving tying mechanism 21. First, the full roving bobbin transfer mechanism 16 is actuated, whereby the bobbin exchange arm assembly 81 is moved vertically. The full roving bobbins F whose roving ends are grasped by the roving tying head assembly PH are removed from the bobbin hangers 11*a* and placed to the state illustrated in FIG. 25(*c*) and FIGS. 37 and 38. In order to prevent a tension from being applied to the succeeding rovings R2 extending continuously to the roving tying head assembly PH from the full roving bobbins F in the course of movement of the roving tying head assembly PH, the electric motor 95 is driven in synchronism with the displacement of the roving tying head assembly PH to rotate the pegs 83 in the direction in which the succeeding rovings R2 are delivered from the full roving bobbins F.

Figure 26:
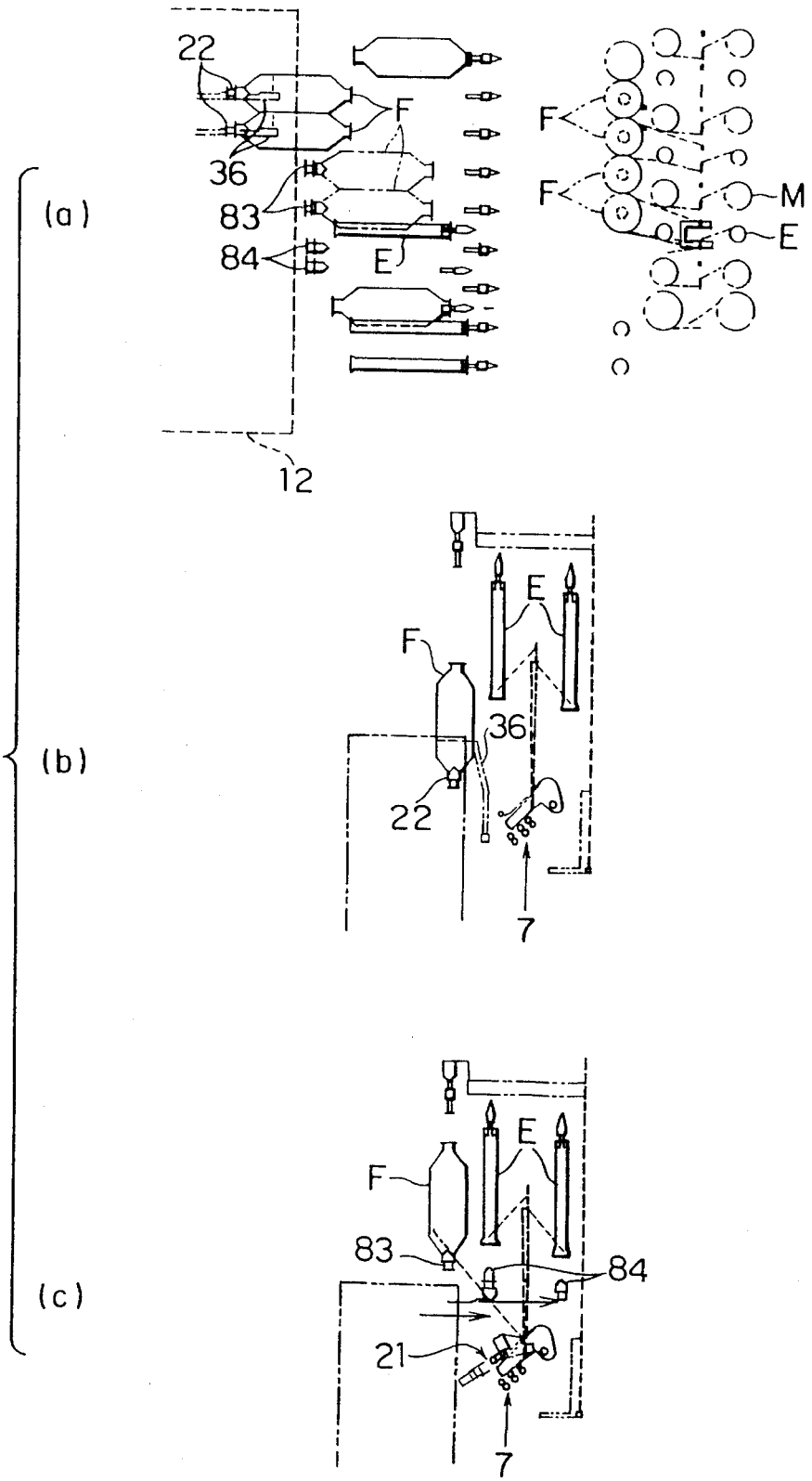
FIGS. 26(*a*) to (*c*) are views for illustrating the roving changing operation performed by the roving bobbin changing apparatus in a third operation phase.
Figure 27:
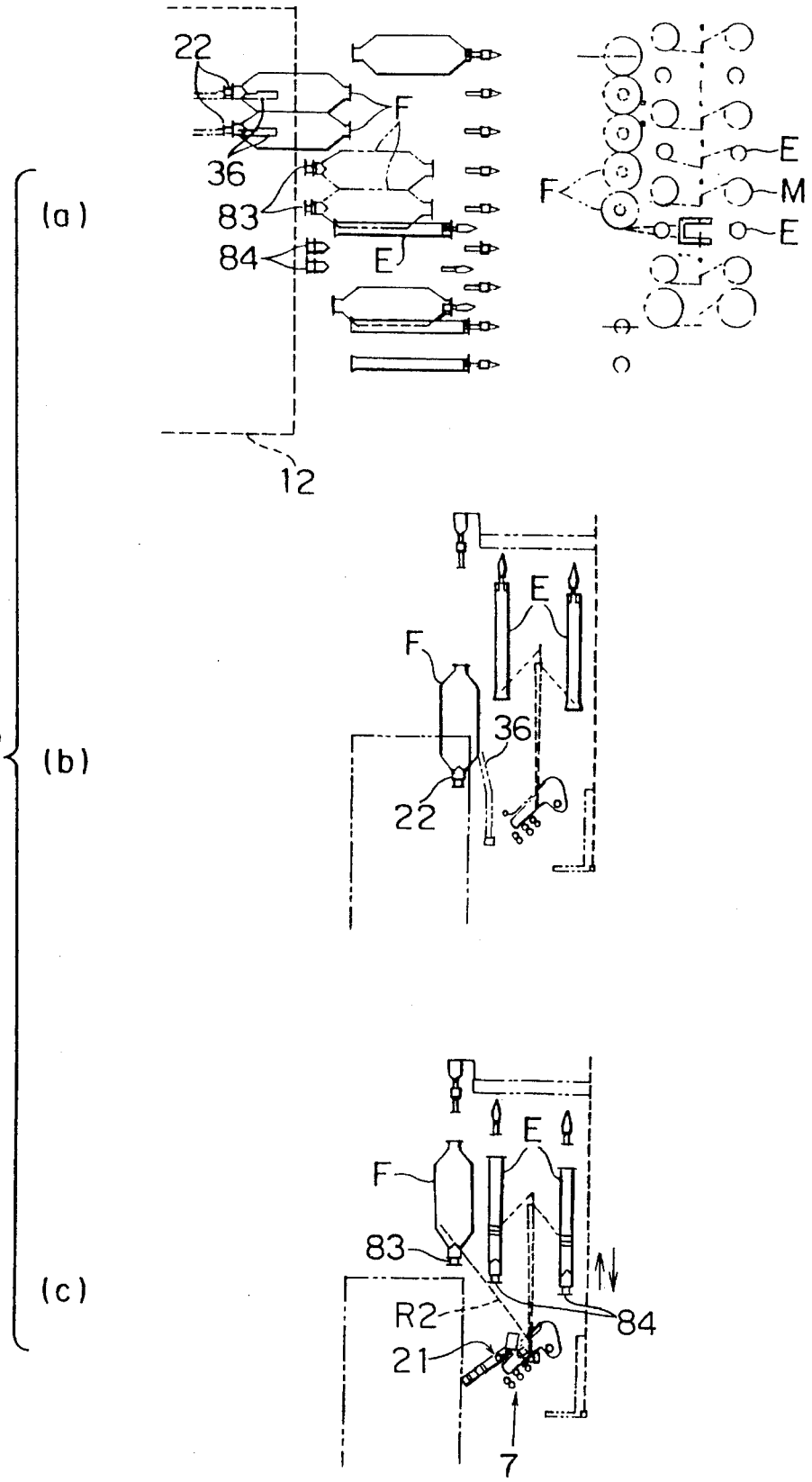
FIGS. 27(*a*) to (*c*) are views for illustrating the roving changing operation performed by the roving bobbin changing apparatus in a fourth operation phase.
Figure 39:
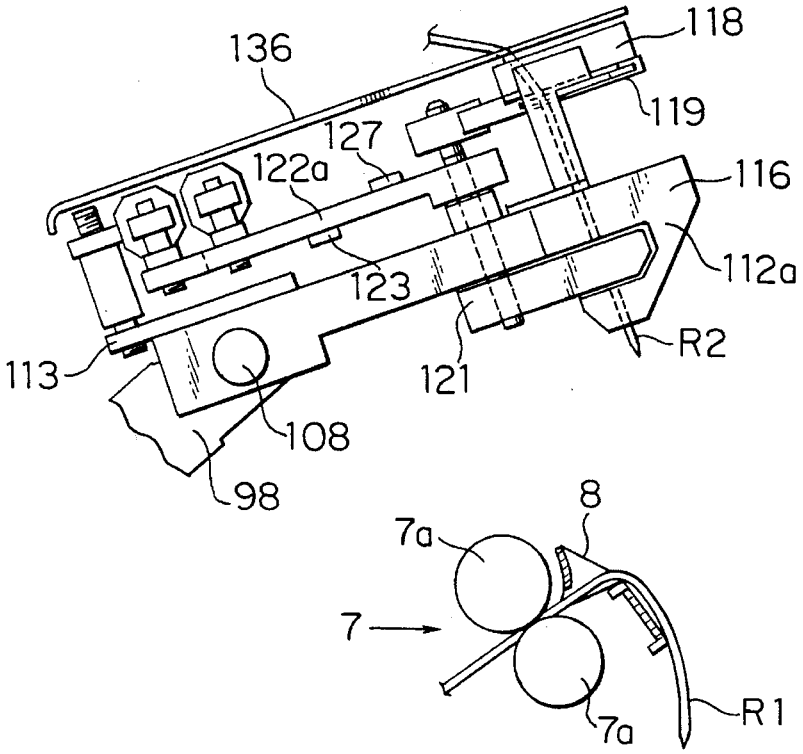
FIG. 39 is a schematic side view for illustrating a state in which old or preceding rovings are cut.

During of displacement of the roving tying head assembly PH toward the spinning machine, the preceding rovings R1 are introduced into the roving guide channel 114. After the roving tying head assembly PH has been disposed in the state shown in FIG. 38, the roving drawing member 125 is disposed at the operating position shown in FIG. 11(*b*). After lapse of a predetermined time in this state, the electric motor 110 is driven, whereby the roving tying head assembly PH is caused to revolve in the counterclockwise direction from the position shown in FIG. 38, i.e., in the direction in which the distal end of the roving tying head assembly PH is moved away from the trumpet 8. As a result of this, the preceding rovings R1 are subjected to a pulling force and cut without fail at a thin portion thereof located at a position immediately succeeding to the comb member 119 in the state in which the fibers of the rovings are loosened. Thereafter, the preceding rovings R1 extending to the draft part 7 are disengaged from the roving guide channel 114 to assume the state in which the rovings suspend downwardly to the rear side of the trumpet 8, as shown in FIG. 39. In the meanwhile, the roving-depleted bobbin transfer mechanism 17 is actuated to incline frontwards the bobbin exchange arm assembly 82 to the position at which the pegs 84 are located closely to the roving-depleted bobbin E, as shown in FIG. 26(*c*).

Next, the roving drawing member 125 is restored to the stand-by position. Further, after lapse of a predetermined time as of the cutting of the preceding rovings R1, the roving tying head assembly PH is rotated in the clockwise direction, from the position viewed in FIG. 39, whereby the end portions of the succeeding rovings R2 are inserted into the trumpet 8. At a time point when the end portions of the succeeding rovings R2 are fed to the back roller 7*a*, the air cylinder 132 is actuated for releasing the succeeding rovings R2 from the state gripped by the grasping member 121. The succeeding rovings R2 are then caused to pass through the back roller 7*a* in the state overlaid on the preceding rovings R1, whereby the roving tying operation is effectuated. Thereafter, the succeeding rovings R2 are fed to the spinning machine in place of the preceding rovings R1. In the meanwhile, the lift mechanism 65 of the roving-depleted bobbin transfer mechanism 17 is driven, whereby the pegs 84 are vertically moved together with the bobbin exchange arm assembly 82, which results in the stage shown in FIG. 27(*c*) where the roving-depleted bobbins E are dismounted from the bobbin hangers 5.

In the case of the hitherto known apparatus, the bobbin exchange arm assemblies 81 and 82 are vertically moved by a common lift mechanism. Consequently, removal of the roving-depleted bobbins E during the roving tying operation exerts adverse influence on the roving tying operation. Thus, it was necessary to delay the operation for dismounting the roving-depleted bobbins E until the roving tying operation was completed. In contrast, in the case of the apparatus according to the instant embodiment of the invention, the bobbin exchange arm assemblies 81 and 82 can be lifted or lowered independently of each other. Thus, it is possible to dismount the roving-depleted bobbins E during the roving tying operation, which means that the time required for a series of roving tying and bobbin exchange processes can be shortened.

Figure 28:
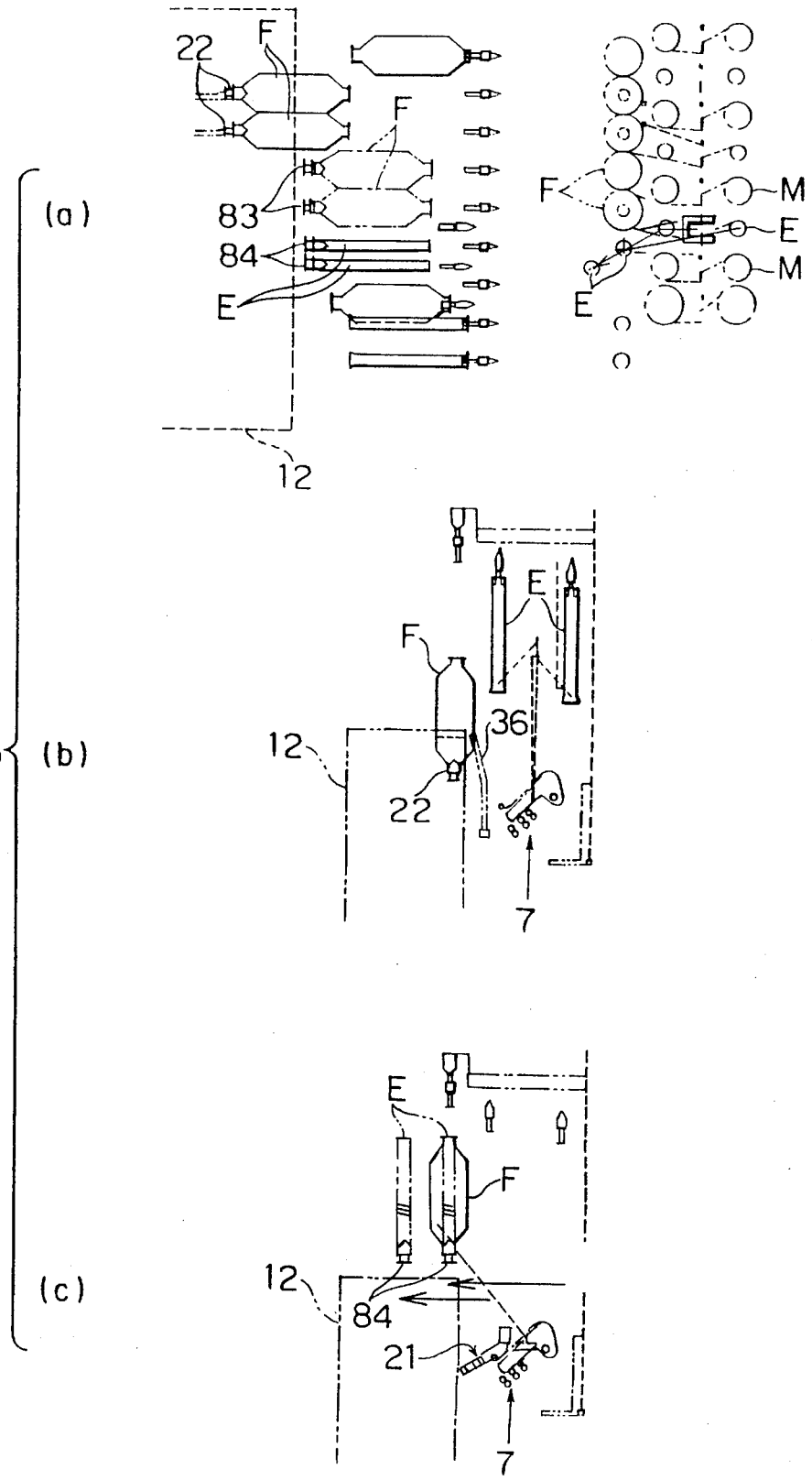
FIGS. 28(*a*) to (*c*) are views for illustrating the roving changing operation performed by the roving bobbin changing apparatus in a fifth operation phase.
Figure 29:
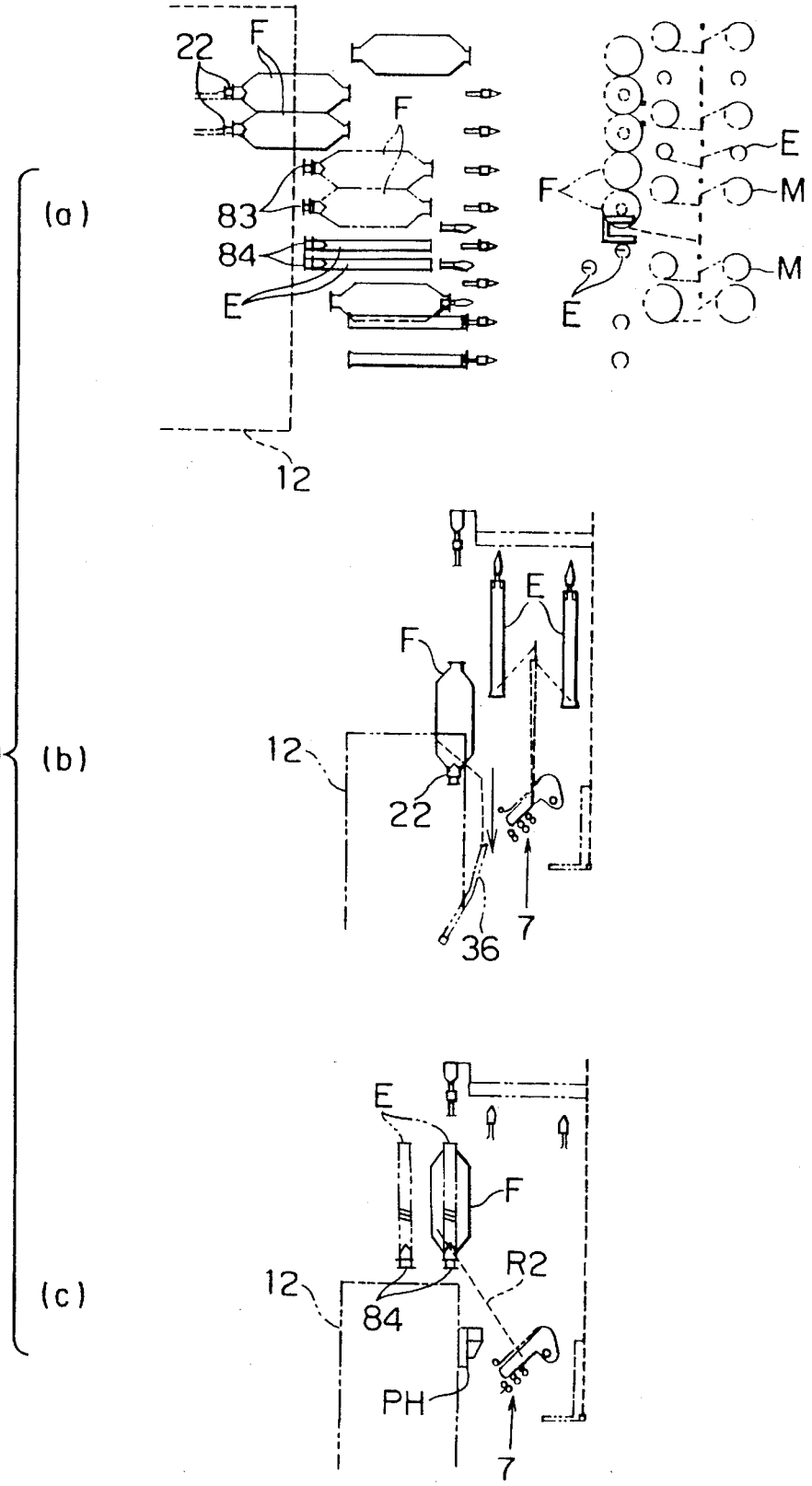
FIGS. 29(*a*) to (*c*) are views for illustrating the roving changing operation performed by the roving bobbin changing apparatus in a sixth operation phase.

Starting from the state described above, the electric motor 96 is driven, whereby the pegs 84 are rotated in the direction to take up the residual roving extending downwardly from the roving-depleted bobbins E via the roving guide 6. Further, the bobbin exchange arm assembly 82 is retracted with the pegs 84 being moved back to above the roving bobbin changing apparatus 12, as shown in FIG. 28(*c*). Subsequently, the arm driving electric motor 100 is driven in the reverse direction to thereby restore the supporting arm 98 to the stand-by position, while the electric motor 110 is also driven in the reverse direction, as a result of which the roving tying head assembly PH is revolved to the stand-by position where the roving tying head assembly PH extends in parallel with the supporting arm 98, as shown in FIG. 29(*c*). At this time point, in the roving end finding/pick-up section A1, the roving end finding/pick-up operation has been completed. This stage is illustrated in FIG. 29(*b*).

Figure 30:
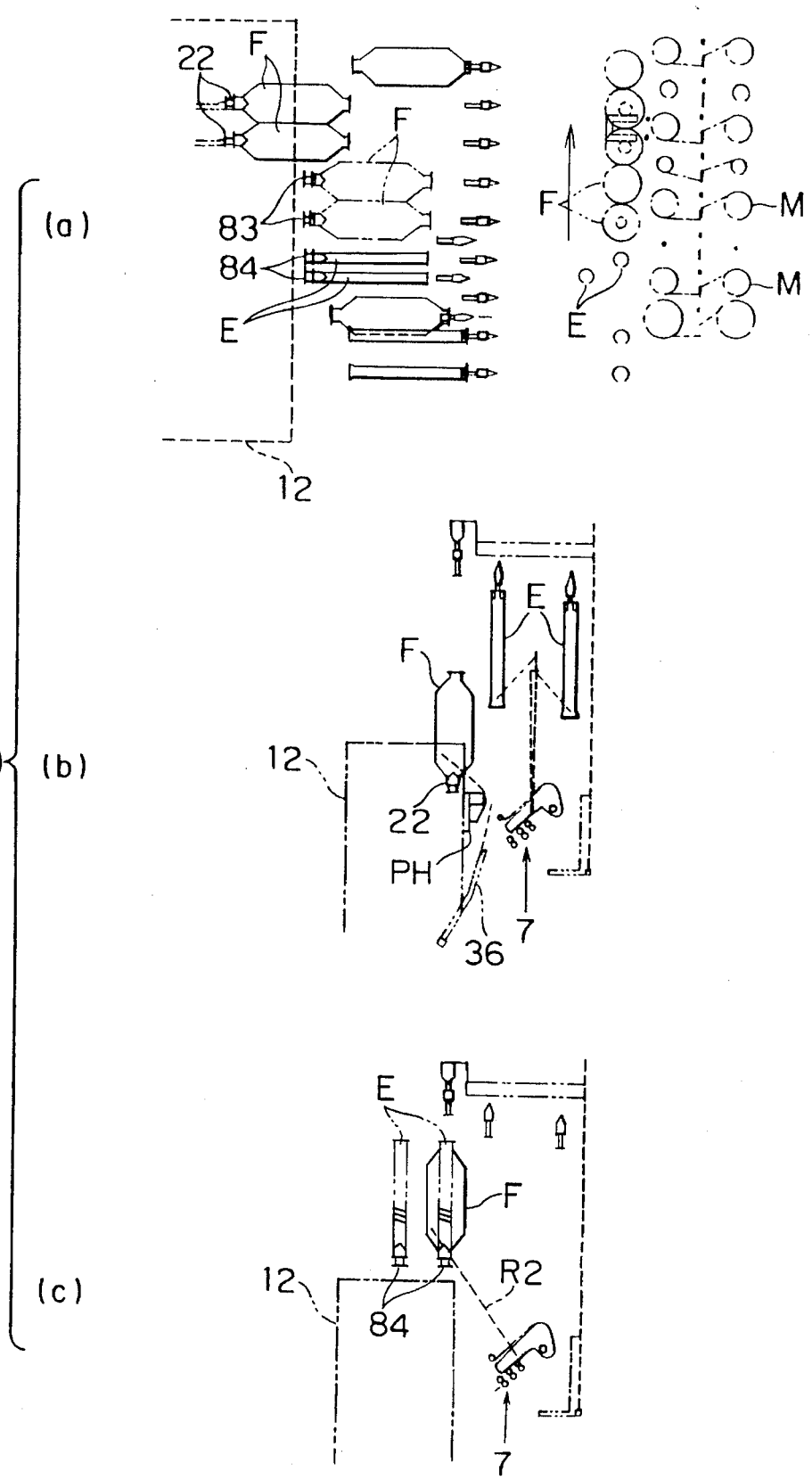
FIGS. 30(*a*) to (*c*) are views for illustrating the roving changing operation performed by the roving bobbin changing apparatus in a seventh operation phase.

In succession, the electric motor 103 is driven to move the roving tying mechanism 21 to the roving end finding/pick-up section A1. When the roving tying head assembly PH has reached a position facing the suction nozzle 36, as shown in FIG. 30(*b*), the electric motor 103 is stopped. After displacement of the roving tying mechanism 21 into the roving end finding/pick-up section A1, the roving attaching or hanging operation is performed by the roving attaching mechanism 19 in the roving tying/bobbin exchange section A2.

In the state where the roving attaching mechanism 19 is disposed at the stand-by position, both the stationary roving guide 156 and the movable roving guide 157 are so oriented as to extend downwardly, as indicated by a phantom line in FIG. 15. The stationary roving guide 156 and the movable roving guide 157 are held with a distance therebetween. Starting from this state, the reversible motor 144 is driven in the forward direction, whereby both the stationary roving guide 156 and the movable roving guide 157 are moved to the roving pick-up position facing the succeeding rovings R2 fed to the draft part 7 from the full roving bobbins F disposed on the full roving bobbin transfer mechanism 16 after the roving tying operation. Subsequently, the reversible motor 150 is driven in the forward direction, whereby the stationary roving guide 156 as well as the movable roving guide 157 is revolved in the counterclockwise direction, as viewed in FIG. 15, to thereby scoop up or take up the succeeding rovings R2 extending from the full roving bobbins F to the draft part 7. To this end, the stationary roving guide 156 and the movable roving guide 157 are revolved to the pitch changing position where the stationary roving guide 156 and the movable roving guide 157 extend substantially horizontally.

Subsequently, the air cylinder 159 is actuated to thereby adjust the distance between the stationary roving guide 156 and the movable roving guide 157 so that the above distance corresponds to a distance between two openings the roving guide 6. Thereafter, the reversible motor 150 is further rotated in the forward direction to thereby revolve the stationary roving guide 156 and the movable roving guide 157 to a roving attaching position where the stationary roving guide 156 and the movable roving guide 157 extend upwardly, as indicated by a solid line in FIG. 15. Next, the reversible motor 144 is driven in the reverse direction, whereby both the V-like guide grooves 156*a* and 157*a* are transversely moved to the position at which these grooves face the openings of the roving guide 6. In succession, the air cylinder 140 is actuated, whereby the roving attaching mechanism 19 as a whole is inclined frontwards, as indicated by a phantom line in FIG. 15, which results in that the end portions of the succeeding rovings R2 engaging both the stationary roving guide 156 and the movable roving guide 157 are introduced into the roving guide 6.

Figure 31:
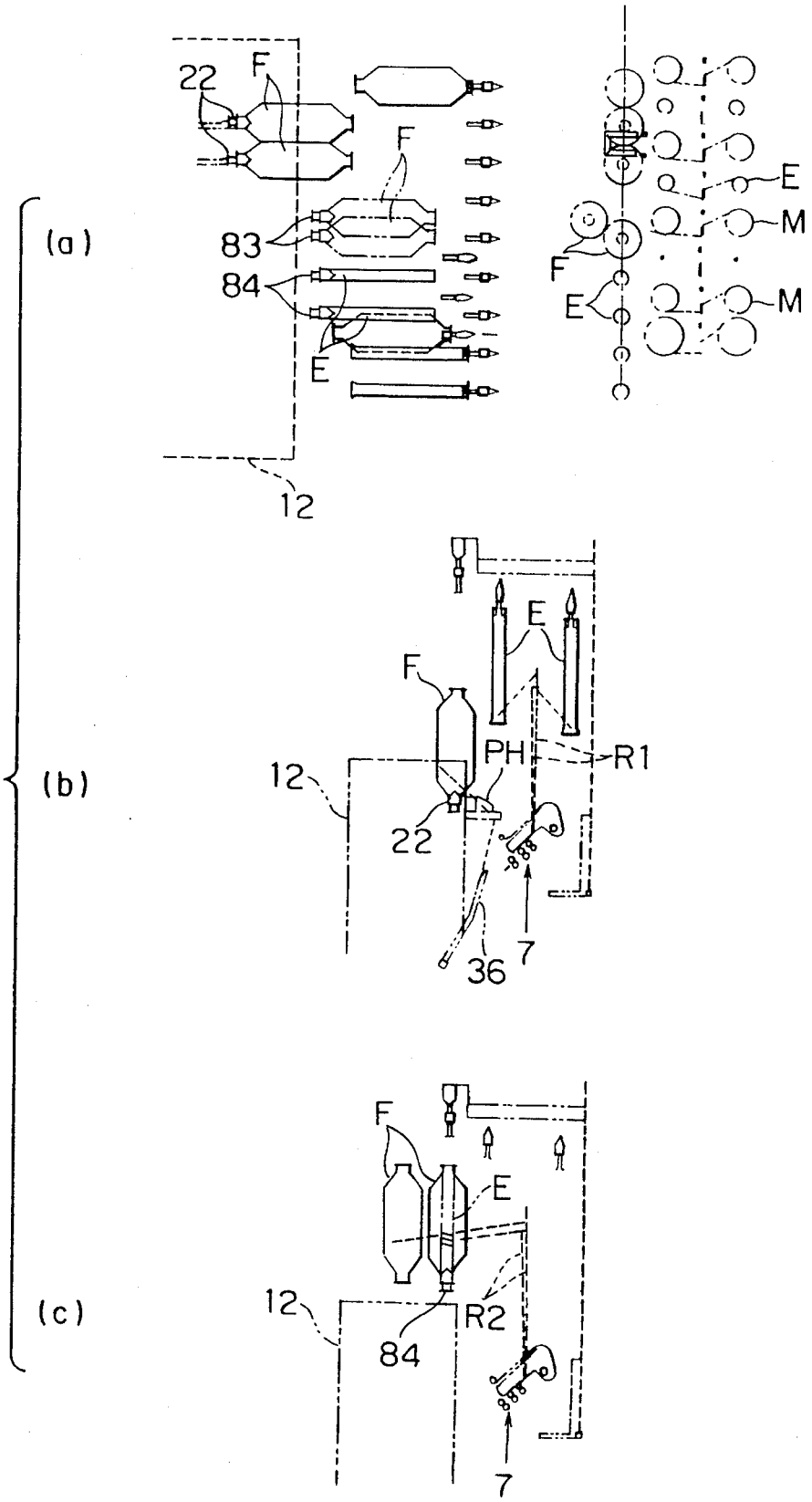
FIGS. 31(*a*) to (*c*) are views for illustrating the roving changing operation performed by the roving bobbin changing apparatus in an eighth operation phase.

In the state mentioned above, the reversible motor 144 is driven in the forward direction, whereby the succeeding rovings R2 are retained by a retaining portion (not shown) of the roving guide 6. Next, the air cylinder 140 is actuated to restore the roving attaching mechanism 19 as a whole to the position indicated by a solid line in FIG. 15. As a result of this, the succeeding rovings R2 are disengaged from the stationary roving guide 156 and the movable roving guide 157 and introduced into the trumpet 8 via the roving guide 6. Thereafter, both the stationary roving guide 156 and the movable roving guide 157 are displaced to the stand-by position. Further, the air cylinders 91 and 92 are driven to revolve the vertically movable base plates 79 and 80 of the full roving bobbin transfer mechanism 16 and the roving-depleted bobbin transfer mechanism 17, respectively. The pegs 83 having the full roving bobbins F mounted thereon, as shown in FIG. 7, assume the state where the pegs 83 extend substantially orthogonally relative to the longitudinal axis of the roving bobbin changing apparatus 12, while the pegs 84 having the roving-depleted bobbins E mounted thereon are oriented in the direction longitudinally of the roving bobbin changing apparatus 12, as shown in FIG. 31(*c*).

Figure 32:
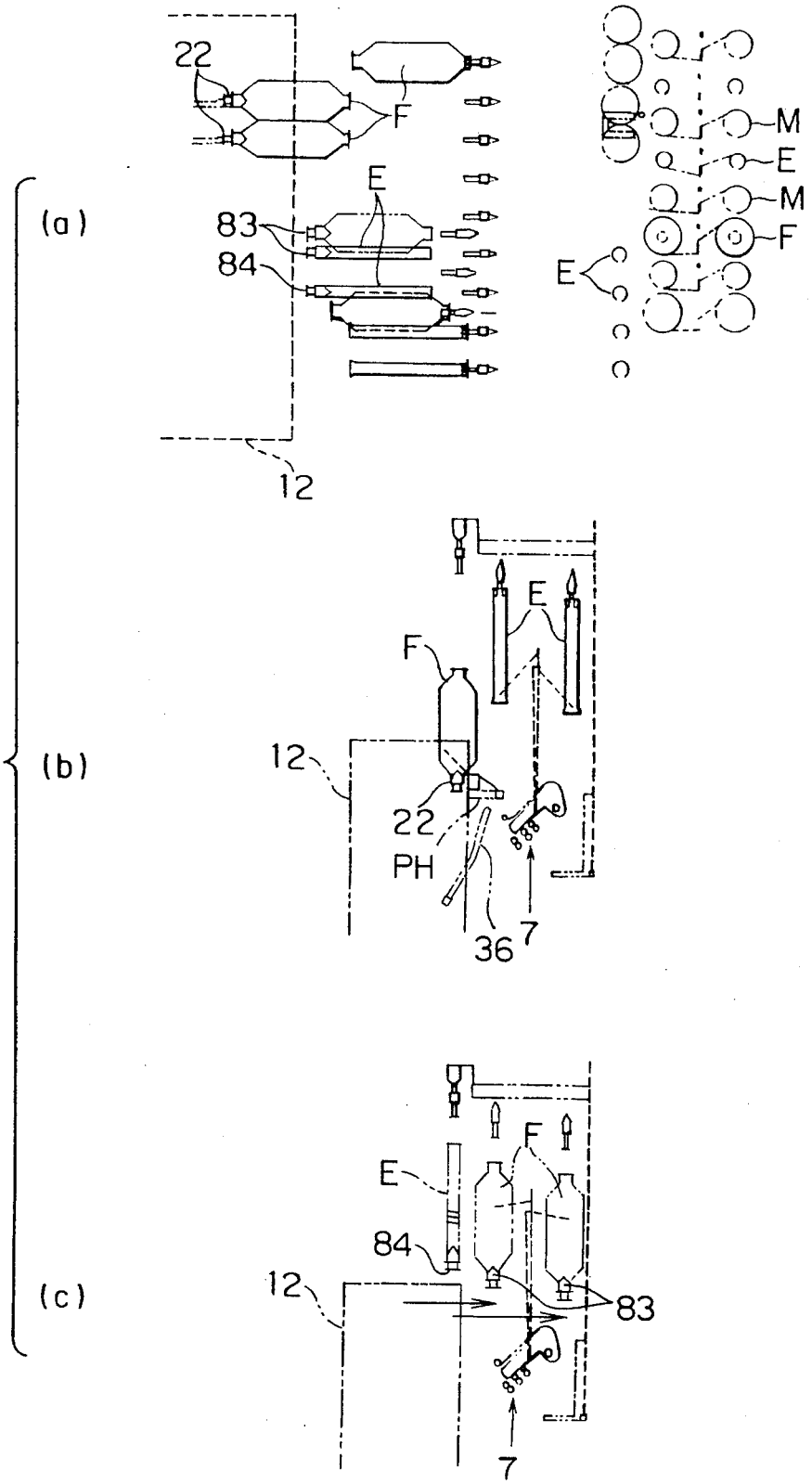
FIGS. 32(*a*) to (*c*) are views for illustrating the roving changing operation performed by the roving bobbin changing apparatus in a ninth operation phase.
Figure 33:
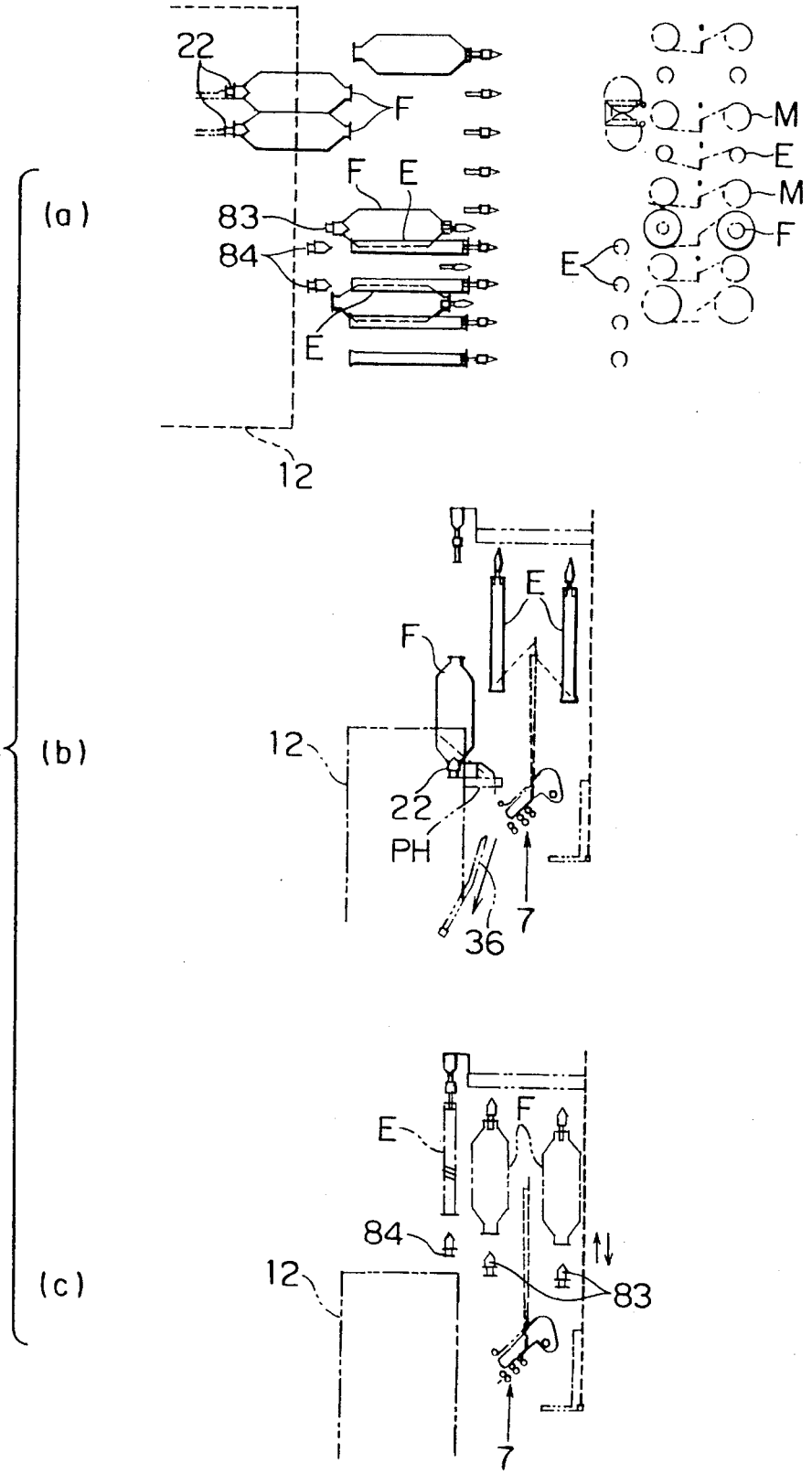
FIGS. 33(*a*) to (*c*) are views for illustrating the roving changing operation performed by the roving bobbin changing apparatus in a tenth operation phase.

Next, the full roving bobbin transfer mechanism 16 is actuated to incline the bobbin exchange arm assembly 81 frontwards to the position where the full roving bobbins F face the bobbin hangers 5, as shown in FIG. 32(*c*). In succession, the lift mechanism 64 is actuated, whereby the full roving bobbins F are vertically moved together with the supporting plate 85 to be suspended on the bobbin hangers 5, as shown in FIG. 33(*c*). Thereafter, the bobbin exchange arm assembly 81 is retracted.

On the other hand, the roving-depleted bobbin transfer mechanism 17 is adapted to suspend the roving-depleted bobbins E dismounted from the bobbin hangers 5 of the creel 2, from to the bobbin hanger 11*a* from which the full roving bobbin F was removed in the preceding roving changing cycle. Consequently, in the first roving changing cycle, the pegs 84 of the roving-depleted bobbin transfer mechanism 17 are not in the state facing the bobbin hangers 11*a* from which the full roving bobbins F have been dismounted. Thus, the roving-depleted bobbins E can not be suspended on the bobbin hangers 11*a*. Under the circumstances, the roving-depleted bobbin holding mechanism 20 is actuated to allow the roving-depleted bobbins E on the roving-depleted bobbin transfer mechanism 17 to be grasped by the bobbin grasping mechanism 161. Thereafter, the roving-depleted bobbin holding mechanism 20 grasping the roving-depleted bobbins E is disposed at the stand-by position where the bobbin exchange arm assemblies 81 and 82 can be moved without encountering any obstacle, until all the full roving bobbins F suspended on the bobbin hangers 11*a* have been dismounted. Subsequently, the roving-depleted bobbins E are returned onto the pegs 84 of the roving-depleted bobbin transfer mechanism 17 and suspended on the bobbin hanger 11*a* from which the full roving bobbins F were last removed.

After the bobbin exchange arm assembly 81 is restored from the position inclined frontwards with the roving-depleted bobbins E being held by the roving-depleted bobbin holding mechanism 20, the roving bobbin changing apparatus 12 is again moved by a predetermined pitch. In response to a signal indicating the start of movement of the roving bobbin changing apparatus 12, the air cylinder 91 and the cylinder 92 of the full roving bobbin transfer mechanism 16 and the roving-depleted bobbin transfer mechanism 17 are actuated to revolve the vertically movable base plates 79 and 80, respectively.

Next, in the roving end finding/pick-up section A1 and the roving tying/bobbin exchange section A2, operations similar to those described above are carried out in parallel. However, in the roving changing cycles following the second cycle inclusive thereof, the bobbin exchange arm assembly 82 is moved up and down in place of the roving-depleted bobbin holding mechanism 20 after completion of the roving attaching operation in the roving tying/bobbin exchange section A2. Concurrently with the operation for hanging the full roving bobbins F on the bobbin hangers 5 of the creel 2, the roving-depleted bobbin transfer mechanism 17 is actuated to hang the roving-depleted bobbins E on the bobbin hangers 11*a* from the pegs 84.

As will now be appreciated from the foregoing description, during the period in which the roving bobbin changing apparatus 12 is stopped at the work position, the roving end finding/pick-up operation and the roving tying/bobbin exchanging operation are carried out substantially simultaneously in the roving end finding/pick-up section A1 and the roving tying/bobbin exchange section A2, respectively. Since the time taken for carrying out the-roving end finding/pick-up operation is approximately equal to the time taken for the roving tying/bobbin exchanging operation, the time for which the roving bobbin changing apparatus 12 must stay in one work position corresponds to the time required for completing the roving end finding/pick-up operation or roving tying/bobbin exchanging operation. Thus, when compared with the hitherto known roving changing process according to which the roving end finding/pick-up operation and the roving tying operation are performed sequentially in one work section, while in another work section the bobbin exchanging operation is performed simultaneously, the time required for the bobbin exchange per spinning machine can be significantly shortened according to the teachings of the invention disclosed herein.

Besides, when compared with another conventional process according to which the work section is divided into the roving end finding/pick-up section, the roving tying section and the bobbin exchanging section, control for the operations effected by roving changing apparatus according to the invention can be remarkably simplified notwithstanding the fact that the time taken for the bobbin exchange per spinning machine is substantially equal to the corresponding time required in the conventional apparatus. Parenthetically, when some fault or trouble occurs during operation, the individual mechanisms are restored to the respective original positions. In this conjunction, it should be mentioned that the burden imposed on the operator can be much reduced as compared with the conventional apparatus where the work section is divided into three subsections mentioned above.

It should further be added that the invention is never restricted to the embodiment described above and shown in the drawings. By way of example, the sequence or timing for effecting the various operations in the roving end finding/pick-up section A1 and the roving tying/bobbin exchange section A2 need not necessarily be so set as illustrated in FIGS. 24 to 35.

Further, the roving end finding/pick-up mechanism 15, the roving bobbin exchanging mechanism 18, the roving attaching mechanism 19, the roving-depleted bobbin holding mechanism 20 and the roving tying mechanism 21 are not limited exactly to the structures described above but may undergo modifications, change of equivalent parts and other variations. By way of example, the roving end finding/pick-up mechanism 15 and the roving bobbin exchanging mechanism 18 may be replaced by apparatuses disclosed in Japanese Unexamined Patent Application Publication No. 127368/1990 (JP-A-H2-127368). Additionally, as the roving tying mechanism 21, the apparatus disclosed in Japanese Unexamined Patent Application Publication Nos. 127368/1990, 352831/1992 or 44125/1993 (JP-A-H2-127368, JP-A-H4-352831 or JP-A-H5-44125) may be employed.

Besides, in place of providing the full roving bobbin transfer mechanism 16 and the roving-depleted bobbin transfer mechanism 17 as the roving bobbin exchanging mechanism, it is possible to provide one bobbin changer equipped with a single set of pegs for effecting the exchange of the roving-depleted bobbin E with the full roving bobbin F, as is disclosed in (JP-A-63-57478). In that case, the whole bobbin changer is so implemented as to be reciprocatively movable in the direction longitudinal of the roving bobbin changing apparatus 12, wherein in the roving tying/bobbin exchanging operation, the full roving bobbins F are first suspended on the bobbin hanger 11*a* after the roving tying operation has been completed. In this state, the roving-depleted bobbins E are taken out from the creel and suspended on the bobbin hangers 11*a*, whereupon the full roving bobbins F are disposed on the bobbin changer to perform the roving introducing and attaching operation.

Additionally, such a roving tying method may equally be adopted according to which the succeeding rovings R2 are inserted into the trumpet 8 from above the preceding rovings R1 which extend continuously from the roving guide 6 to the draft part 7 and then the preceding roving R1 is cut.

Finally, it should also be mentioned that the invention is never limited to the bobbin exchange between a pair of inner and outer roving-depleted bobbins E and the roving-filled bobbins F but may find application to a bobbin changing method in a system in which the roving-depleted bobbins E are adapted to be disposed outside of the creel 2. In that case, the number of the bobbins handled at one time in each of the work sections may be increased to three or more without incurring complication in the structure of the apparatus.

We claim:

1. A method for changing roving bobbins in a spinning machine, wherein exchanging of roving depleted bobbins suspended on bobbin hangers of a creel of said spinning machine while delivering rovings to undergo spinning, with full roving bobbins suspended on an auxiliary rail disposed adjacent to said creel, is carried out by roving bobbin changing apparatus which is adapted to move along the length of said spinning machine from one end to the other end of a machine frame of said spinning machine, characterized by the steps of:

providing said roving bobbin changing apparatus with a roving end finding/pick-up section and a roving tying/bobbin exchange section, said roving end finding/pick-up section being coupled to said bobbin changing apparatus at a position ahead of said roving tying/bobbin exchange section when viewed in the direction of movement of said bobbin changing apparatus relative to said spinning machine; said roving bobbin changing apparatus cyclically performing a) an operation for finding roving ends from at least two full roving bobbins disposed on said auxiliary rail in said roving end finding/pick-up section, b) an operation for tying roving ends found and picked up from others of said full roving bobbins in an immediately preceding cycle to rovings of said roving-depleted bobbins from which rovings are being delivered in said roving tying/bobbin exchange section, and c) an operation for transferring others of said roving-depleted bobbins to said auxiliary rail while transferring to said bobbin hangers of said creel said full roving bobbins which have had roving ends tied in the current cycle and from which the rovings are concurrently being delivered, wherein step a) is performed substantially concurrently with steps b) and c).

2. A roving bobbin changing apparatus including roving end finding/pick-up means for finding and picking up roving ends from at least two full roving bobbins disposed on an auxiliary rail extending alongside a creel of a spinning machine, roving tying means for tying to rovings of roving-depleted bobbins said roving ends that have been found and picked up from said full roving bobbins, and roving bobbin exchanging means for transferring said roving-depleted bobbins to said auxiliary rail while transferring to bobbin hangers of said creel said full roving bobbins from which previously tied rovings are being delivered for spinning, said apparatus being characterized in that:

said roving bobbin changing apparatus comprises a roving end finding/pick-up section and a roving tying/bobbin exchange section; and said roving-end finding/pick-up means is disposed in said roving end finding/pick-up section and said roving bobbin exchanging means is disposed in said roving tying/bobbin exchange section, said roving end finding/pick-up section being coupled to said bobbin changing apparatus at a position ahead of said roving tying/bobbin exchange section when viewed in the direction of movement of said bobbin changing apparatus relative to said spinning machine for substantially concurrent and cyclical operation with said roving tying means and said roving bobbin exchanging means, said roving bobbin exchanging means being reciprocatably movable between said roving end finding/pick-up section and said roving tying/bobbin exchange section; and driving means for moving said roving bobbin exchanging means to a position for grasping new rovings in said roving end finding/pick-up section, and to a roving tying position corresponding to that of full roving bobbins transfer means in said roving tying/bobbin exchange section;

such that said roving end finding/pick-up means finds and picks up roving ends from at least two full roving bobbins while said roving tying means ties roving ends found and picked up in an immediately preceding cycle by said roving end finding/pick-up means to rovings of roving depleted bobbins and said roving bobbin exchanging means transfers said roving depleted bobbins to said auxiliary rail while transferring to said bobbin hangers said full roving bobbins which have had roving ends tied in the current cycle and from which rovings are concurrently being delivered.

3. A roving bobbin changing apparatus according to claim 2, characterized in that said roving bobbin exchanging means is comprised of a full roving bobbin transfer means and a roving-depleted bobbin transfer means, wherein said full roving bobbin transfer means and said roving depleted bobbin transfer means are so arranged as to be driven independent of each other.

4. A roving bobbin changing apparatus according to claim 3, characterized in that said full roving bobbin transfer means is disposed, as viewed in the direction in which said roving bobbin changing apparatus is moved for performing the roving bobbin exchanging operation, ahead of said roving-depleted bobbin transfer means; and that separate respective independently operable lift means are provided for said full roving bobbin transfer means and said roving-depleted bobbin transfer means.

5. A roving bobbin changing apparatus according to claim 4, characterized in that said lift means are each equipped with a respective bobbin exchange arm means capable of being lifted and lowered independent of the exchange arm means of the other.

6. A roving bobbin changing apparatus according to claim 4, characterized in that a rotatable spline shaft is disposed at an upper front side of said roving bobbin changing apparatus and extends in parallel to the moving direction of said roving bobbin changing apparatus from said roving end finding/pick-up section to a position corresponding to that of said full roving bobbin transfer means in said roving tying/bobbin exchange section, and that said roving bobbin changing apparatus is constructed for movement reciprocatively between said roving end finding/pick-up section and said roving tying/bobbin exchange section along said rotatable shaft.

7. A roving bobbin changing apparatus according to claim 6, characterized in that said roving tying bobbin exchange section further includes roving attaching means for introducing into a roving guide new rovings extending to a draft part from full roving bobbins after completion of the roving tying operation, and roving-depleted bobbin holding means.

8. A roving bobbin changing apparatus according to claim 2, characterized in that said roving end finding/pick-up section further includes a full roving bobbin support/lift means disposed in the vicinity of said roving end finding/pick-up means for removing full roving bobbins from said bobbin hangers to a position where roving end finding/pick-up operation can easily be carried out.

9. A roving bobbin changing apparatus according to claim 8, characterized in that said full roving bobbin transfer means includes a supporting platform provided with a pair of pegs for supporting said full roving bobbins, respectively, and driving means for moving selectively upwardly and downwardly said supporting platform.

10. A roving bobbin changing apparatus according to claim 2, characterized in that said roving end finding/pick-up means includes a roving chip collecting box disposed underneath said roving chip collecting box through a hose, and a pair of suction nozzles connected to said roving chip collecting box through a suction pipe.

11. A roving bobbin changing apparatus according to claim 2, characterized in that said roving bobbin exchanging means includes a single bobbin exchanging means provided with one set of pegs.

* * * * *

UNITED STATES PATENT AND TRADEMARK OFFICE

CERTIFICATE OF CORRECTION

PATENT NO. : 5,586,428

DATED : December 24, 1996

INVENTOR(S) : Asai et al

It is certified that error appears in the above-indentified patent and that said Letters Patent is hereby corrected as shown below:

Column 1, line 43, "positions" should read --position--.

Column 16, line 24, "54" should read --154--.

Column 17, line 8, delete "mechanism".

Column 18, line 25, after "which" delete comma ",".

Column 20, line 1, after "during" delete "of".

Column 21, line 48 after "openings" insert --of--.

Column 22, line 33, after "from" delete "to".

Signed and Sealed this

First Day of July, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,586,428

DATED : December 24, 1996

INVENTOR(S) : Asai et al

It is certified that error appears in the above-indentified patent and that said Letters Patent is hereby corrected as shown below:

Column 26, line 48, after "roving" insert --bobbin changing apparatus, a blower connected to said roving--.

Signed and Sealed this

Ninth Day of December, 1997

*Attest:*

BRUCE LEHMAN

*Attesting Officer*

*Commissioner of Patents and Trademarks*